US008602750B2

(12) United States Patent
Takeishi

(10) Patent No.: US 8,602,750 B2
(45) Date of Patent: Dec. 10, 2013

(54) LIQUID SUPPLY DEVICE

(75) Inventor: Toshio Takeishi, Koganei (JP)

(73) Assignee: Koganei Corporation, Tokyo (JP)

( * ) Notice: Subject to any disclaimer, the term of this patent is extended or adjusted under 35 U.S.C. 154(b) by 212 days.

(21) Appl. No.: 13/082,736

(22) Filed: Apr. 8, 2011

(65) Prior Publication Data

US 2011/0253750 A1 Oct. 20, 2011

(30) Foreign Application Priority Data

Apr. 20, 2010 (JP) ..... 2010-96630

(51) Int. Cl.
*F04B 17/04* (2006.01)

(52) U.S. Cl.
USPC ..... 417/388; 417/389

(58) Field of Classification Search
USPC ..... 222/386, 380, 212, 491, 494, 137; 417/388, 389, 383, 386, 394, 39, 478, 417/473; 92/90
See application file for complete search history.

(56) References Cited

U.S. PATENT DOCUMENTS

| | | | | |
|---|---|---|---|---|
| 3,607,094 | A * | 9/1971 | Beer | 422/63 |
| 4,243,160 | A * | 1/1981 | Reil | 222/373 |
| 5,282,492 | A * | 2/1994 | Angeli | 137/493.4 |
| 6,085,943 | A * | 7/2000 | Cavallaro et al. | 222/309 |
| 6,183,223 | B1 * | 2/2001 | Yajima | 417/478 |
| 6,238,576 | B1 * | 5/2001 | Yajima | 210/767 |
| 6,539,986 | B2 * | 4/2003 | Yajima | 141/2 |
| 6,668,856 | B2 * | 12/2003 | Warlick | 137/533.17 |
| 6,733,250 | B2 * | 5/2004 | Yajima | 417/313 |
| 7,806,668 | B2 * | 10/2010 | Yajima | 417/383 |
| 7,841,842 | B2 * | 11/2010 | Yajima | 417/394 |
| 7,871,250 | B2 * | 1/2011 | Yajima | 417/388 |
| 7,887,305 | B2 * | 2/2011 | Yajima | 417/313 |
| 8,047,814 | B2 * | 11/2011 | Yajima | 417/385 |
| 8,133,042 | B2 * | 3/2012 | Yajima | 417/473 |
| 2007/0031273 | A1 * | 2/2007 | Yajima | 417/478 |
| 2008/0115662 | A1 * | 5/2008 | Yajima | 92/90 |
| 2008/0138214 | A1 * | 6/2008 | Yajima | 417/246 |
| 2008/0260549 | A1 * | 10/2008 | Yajima | 417/375 |
| 2011/0163121 | A1 * | 7/2011 | Katseli | 222/1 |
| 2011/0318206 | A1 * | 12/2011 | Yajima | 417/437 |

FOREIGN PATENT DOCUMENTS

| | | | |
|---|---|---|---|
| JP | 7310838 | A | 11/1995 |
| JP | 8170744 | A | 7/1996 |
| JP | 11230048 | A | 8/1999 |
| JP | 2005083250 | A | 3/2005 |
| JP | 2007315295 | A | 12/2007 |

* cited by examiner

*Primary Examiner* — Kevin P Shaver
*Assistant Examiner* — Christopher Luzecky
(74) *Attorney, Agent, or Firm* — McCormick, Paulding & Huber LLP

(57) ABSTRACT

A drive characteristic and durability of a liquid supply device having a flexible pump member such as a bellows are improved. A drive pump in the liquid supply device has a bellows as the pump member that is elastically deformed axially by a drive rod. A drive pump chamber and a communication chamber are formed by the bellows and the housing, and the communication chamber and the drive pump chamber are partitioned by the orifice member. At a drive operation time of the drive rod, the through hole is blocked by the valve member, and a liquid flows in between the communication chamber and the drive pump chamber via a communication gap formed between the orifice member and an inner circumferential face of the housing.

16 Claims, 15 Drawing Sheets

LIQUID SUPPLY DEVICE

CROSS-REFERENCE TO RELATED APPLICATIONS

Applicant hereby claims foreign priority benefits under U.S.C. §119 from Japanese Patent Application No. 2010-96630 filed on Apr. 20, 2010, the contents of which are incorporated by reference herein.

TECHNICAL FIELD OF THE INVENTION

The present invention relates to a liquid supply device, which discharges a given amount of liquid with high accuracy, in particular, a discharges high viscous liquid to a member to be applied (hereinafter "applied member") with a high pressure.

BACKGROUND OF THE INVENTION

To apply a liquid such as a photoresist liquid to a surface of an applied member of a semiconductor wafer or glass board from an application nozzle, a liquid supply device has been used. As the liquid supply device utilized for above use applications, there is a drive pump in form of reciprocating an elastically deformable pump member axially by a drive rod. The drive rod is mounted axially reciprocably in a cylindrical housing, and the elastically deformable pump member is provided axially between a tip portion of the drive rod and the housing, and a pump chamber, i.e., a drive chamber that is expandable and contractible by the pump member is formed in the housing. As the pump member, there are in form of a bellows as disclosed in Japanese Patent Application Laid-Open Publication No. 7-310838, and in the form of a diaphragm as disclosed in Japanese Patent Application Laid-Open Publication No. 8-170744.

The liquid supply devices comprising the drive pumps having structures disclosed in above Patent Documents have supplied a liquid such as a chemical liquid to the applied members directly from the pump chambers that are expanded and contracted by the drive rods. In contrast, for example, disclosed in Japanese Patent Application Laid-Open Publication No. 11-230048 is a liquid supply device of an indirect operation type in which a liquid supply pump, which is provided with a flexible tube that is also called a tubephragm and partitions a pump chamber and a drive chamber, is driven by the drive pump having the above-mentioned form. In the liquid supply device having the above form, the liquid pump is driven indirectly by supplying the liquid to the drive chamber of the liquid supply pump from the pump chamber.

As a drive pump in form of using the bellows, Japanese Patent Application Laid-Open Publication No. 2007-315295 discloses expanding and contracting the bellows to perform a pump operation by supplying gas into the bellows. In the drive pump, to prevent the bellows from deforming inwardly in expanding and contracting the bellows, a restriction member is incorporated into the bellows. Also, in a drive pump in form of a bellows as disclosed in Japanese Patent Application Laid-Open Publication No. 2005-83250, an annular bellows protecting member is attached outside the bellows driven for expansion and contraction by the drive rod, whereby a deformation of an accordion-shaped portion is prevented.

In a pre-processing step of manufacturing semiconductors or liquid crystal panels, the liquid supply device with the above form is used to discharge a liquid such as a photoresist liquid onto semiconductor wafers and glass substrates. The liquid received in a liquid container is sucked by the liquid supply device, and discharged from an applying nozzle. Included in configurations of pumps is a syringe type in addition to the above-mentioned bellows, diaphragm, and tube types. The liquid supply devices used for those types demand chemical resistance for preventing corrosion due to the liquid, and a portion or region contacting with the liquid is mainly made of a fluorocarbon resin, stainless steel, or a ceramics. Further, to apply the liquid to the applied members with uniform thickness to decrease or eliminate product defects such as circuit pattern hiatuses, the liquid supply devices having cleanliness properties and low dust-generating properties are important.

In the liquid supply devices of the bellows and diaphragm types, particularly, since the pump members are elastically deformed at discharge and suction operation times, chemical resistance as well as flexibility are needed for the pump members and, therefore, fluorocarbon resins are selected.

In a step of applying the liquid, pressures in a pump chamber and liquid are generated during discharging and sucking operations by influences due to various conditions such as device or piping conditions, viscosity of the liquid, and discharge flow rates. Since the pump member comprising the bellows or diaphragm made of a fluorocarbon resin is made of an elastic material, when a discharge pressure in discharging the liquid is high, such a pump member is deformed in a direction in which a diameter of the pump member contracts due to a discharge load applied to the pump member. Meanwhile, when a suction negative pressure in sucking the liquid is high, the pump member is deformed in a direction in which the diameter expands due to a suction load applied to the pump member. Consequently, the pump chamber does not expand and contract based on a volume change amount corresponding to a stroke of a drive rod, whereby variations in shortage and accuracy of a discharge amount of the liquid occur. Further, exertion of a high pressure onto the pump member causes deformation, deterioration, and breakage of the pump member comprising the bellows or diaphragm, etc. In the long term, the exertion becomes a factor of deterioration of life time of the liquid supply device.

Deformation of the pump member such as a bellows does not cause the variations in the accuracy of the discharge amount but also make various influences on a delay of a flow rising at a discharge starting time, a flow fluctuation during the discharge, and so on. As a result, thicknesses of layers of the liquids applied to surfaces of the semiconductor wafers become non-uniform, and manufacture yields of semiconductor products are reduced. In an actual semiconductor manufacturing process, to reduce the influence on the flow fluctuation of the liquid discharged from the liquid supply device, drive speed needs to be controlled according to a discharge flow characteristic, and a program recipe for actuating the liquid supply device may be made complicated. Meanwhile, after the liquid is applied thicker than necessary, when the surplus liquid is caused to fly apart for obtaining a desired thickness of the applied liquid, the liquid used becomes waste, and inefficiency on the manufacture and cost rise are difficult to avoid.

The most ideal discharge characteristic of the liquid supply device is to have a rapid rising of the discharge flow at a time of the discharge start, and a discharging operation with a constant flow and without flow fluctuation.

However, the discharge pressure becomes some causes actually, and this influences the discharge accuracy or quality of manufactured products, so that drive conditions of the liquid supply device are restricted depending on pumping performance. Since safety margins regarding pressure resistance performance of the pump are taken, the pump must be used at a low pressure level. For this reason, production under the ideal conditions is difficult, and the life time of the pump is also influenced by conditions of discharged pressures. Consequently, it is not too much to say that limitations on production efficiency and production costs are limited to the pump performance.

The flexible pump member such as bellows and diaphragm is generally a member requiring flexibility as a function, and also need rigidity. Consequently, the pump member requires incompatible performance. However, it is actually difficult at present to obtain the flexibility and rigidity simultaneously.

In contrast, the pump of the syringe type is superior regarding rigidity and pressure resistance performance. The syringe type is in form of pressurizing a liquid by a piston, and has a high pressure resistance performance, so that an influence of the discharge accuracy due to the pressure load is small. However, the piston is in slidable contact with an inner circumferential face of a cylinder, as a result of which occurrence of abrasive powder, i.e., particles from a sliding portion is not avoided, and there is a fear of occurrences of contamination and leakage, etc. of the liquid due to the particles. Accordingly, use of the syringe type pump in a semiconductor manufacturing process involves a very high risk. This needs to do frequent maintenance for inspecting the sliding portion. Therefore, life time of driving the syringe type pump is shorter than other type pumps, and there is a problem in that use efficiency such as maintenance costs or low operation rates due to stop of the manufacturing process is bad. Consequently, this type pump is hardly used in the semiconductor manufacturing process.

An object of the present invention is to improve discharge accuracy of a liquid supply device having a flexible pump member such as a bellows.

Another object of the present invention is to improve durability of the liquid supply device.

SUMMARY OF THE INVENTION

A liquid supply device according to the present invention, which expands and contracts a drive pump chamber by a drive rod, causes a liquid (or indirect operating fluid) to flow in the drive pump chamber, and discharges the inflow liquid toward an outside from the drive pump chamber, comprises: a housing for the drive pump chamber, in which the drive rod is reciprocably mounted forward and backward directions along an axial direction; a pump member provided between the drive rod and the housing, a communication chamber being formed between an inner circumferential face of the housing and the pump member, and the pump member elastically deforming axially according to a movement of the drive rod; an orifice member disposed around the drive rod, and partitioning an interior of the housing into the drive pump chamber and the communication chamber, a communication gap communicating with the drive pump chamber and the communication chamber being formed between an outer circumferential face of the orifice member and the housing; and a valve member disposed at the orifice member, blocking one or more through hole formed in the orifice member when the drive rod is moved forward, and opening the through hole when the drive rod is moved backward, wherein in a state of moving forward the drive rod to close the through hole, the drive pump chamber is driven for pressurization, and in a state of moving backward the drive rod, the liquid in the communication chamber is guided into the drive pump chamber via the though hole.

The liquid supply device according to the present invention is such that the valve member is formed of an annular plate material, and is disposed opposite the plural through holes formed in the orifice member, and an auxiliary gap, which communicates with the drive pump chamber and the communication chamber when the drive rod is moved backward and when the valve member causes the through holes to be opened, is formed on least one side of an inner circumferential face side and an outer circumferential face side of the valve member. The liquid supply device according to the present invention is such that the valve member is disposed outside an annular valve guide attached to the drive rod, and a notch portion, which opens an auxiliary gap formed on an inner circumferential face side of the valve member during a backward movement of the drive rod, is formed in the valve guide.

The liquid supply device according to the present invention further comprises: a housing for liquid, which is provided with an inflow port connected to a liquid inflow pipe, and an outflow port connected to a liquid outflow pipe; and a liquid pump incorporated into the housing for liquid, and provided with an elastically deformable partition film member by which a liquid pump chamber communicating with the inflow and outflow ports, and a drive chamber communicating with the drive pump chamber are partitioned, wherein when the drive rod is moved forward, the partition film member is driven for pressurization by the liquid supplied from the drive pump chamber to the drive chamber. The liquid supply device according to the present invention is such that an inflow port communicating with the drive pump chamber and connected to a liquid inflow pipe, and an outflow port connected to a liquid outflow pipe are provide with the housing for the drive pump chamber, and when the drive rod is moved forward, the liquid is directly discharged from the drive pump chamber to the outflow port.

A liquid supply device according to the present invention, which expands and contracts a drive pump chamber by a drive rod to cause a liquid to flow in the drive pump chamber, and which discharges the inflow liquid exteriorly from the drive pump chamber, comprises: a hosing for the drive pump chamber, in which the drive rod is reciprocably mounted forward and backward directions along an axial direction; a pump member provided between the drive rod and the housing, a communication chamber being formed between an inner circumferential face of the housing and the pump member, and the pump member elastically deforming axially according to a movement of the drive rod; an orifice member disposed around the drive rod, and partitioning an interior of the housing into the drive pump chamber and the communication chamber, a communication gap communicating with the drive pump chamber and the communication chamber being formed between an outer circumferential face of the orifice member and the housing; and a valve member disposed at the orifice member, blocking one or more through hole formed in the orifice member when the drive rod is moved backward, and opening the through hole when the drive rod is moved forward, wherein in a state of moving backward the drive rod to close the through hole, the drive pump chamber is driven for suction, and in a state of moving forward the drive rod, the liquid in the drive pump chamber is guided into the communication chamber via the through hole.

The liquid supply device according to the present invention is such that the valve member is formed of an annular plate material, and is disposed opposite the plural through holes formed in the orifice member, and an auxiliary gap, which communicates with the drive pump chamber and the communication chamber when the drive rod is moved forward and when the valve member causes the through hole to be opened, is formed on least one side of an inner circumferential face side and an outer circumferential face side of the valve member. The liquid supply device according to the present invention is such that the valve member is disposed outside an annular valve guide attached to the drive rod, and a notch portion, which opens an auxiliary gap formed on an inner circumferential face side of the valve member during a forward movement of the drive rod, is formed in the valve guide.

The liquid supply device according to the present invention further comprises: a housing for liquid, which is provided with an inflow port connected to a liquid inflow pipe, and an outflow port connected to a liquid outflow pipe; and a liquid pump incorporated into the housing for liquid, and provided with an elastically deformable partition film member by which a liquid pump chamber communicating with the inflow and outflow ports, and a drive chamber communicating with the drive pump chamber are partitioned, wherein when the drive rod is moved backward, the partition film member is driven for suction by the liquid supplied from the drive chamber to the drive pump chamber. The liquid supply device according to the present invention is such that the housing for the drive pump chamber is provided with an inflow port communicating with the drive pump chamber and connected to a liquid inflow pipe, and an outflow port connected to a liquid outflow pipe, and when the drive rod is moved backward, the liquid is directly sucked into the drive pump chamber from the inflow port.

The liquid supply device according to the present invention is such that a difference between an outer diameter dimension of the outer circumferential face of the orifice member and an inner diameter dimension of an inner circumferential face of the housing for the drive pump chamber is 0.1 mm or less. The liquid supply device according to the present invention is such that an outer diameter dimension of the valve member is smaller than an outer diameter dimension of the orifice member. The liquid supply device according to the present invention is such that the vale member is formed of a ball or poppet valve, and the valve member is disposed in each of a plurality of the through holes formed in the orifice member.

In the liquid supply device according to the present invention, the drive pump chamber and the communication chamber are partitioned by the orifice member. When the drive rod is activated for drive against a discharge load, the liquid flows into the communication chamber from the drive pump chamber via the narrow communication gap formed between the orifice member and the inner circumferential face of the receiving hole, and a length of the communication gap along a flow direction is much larger than a cross-sectional diameter of the communication gap, whereby a sufficient pressure gradient is obtained. Meanwhile, when the drive rod is activated for drive against the suction load, the liquid flows into the drive pump chamber from the communication chamber via the narrow communication gap, and a length of the communication gap along a flow direction is much larger than a cross-sectional diameter of the communication gap, whereby a sufficient pressure gradient is obtained. Accordingly, even if the drive pump chamber becomes in a pressurized state, the pressure in the communication chamber is constant without varying, whereby the pump member is prevented from elastically deforming. Meanwhile, even if the drive pump chamber becomes in a negative pressure state, the pressure in the communication chamber is constant without varying, whereby the pump member is prevented from elastically deforming.

The pump member is prevented from elastically deforming, and the pump member elastically deforms linearly with respect to a stroke movement of the drive rod, so that the rising characteristics of the liquid disposed from the drive pump chamber to an outside, or the liquid sucked into the drive pump chamber from the outside can be improved, and that the discharge accuracy of the pump can be improved.

The pump member is not in slidable contact with the inner circumferential face of the housing, and the communication gap is formed between the outer circumferential face of the orifice member and the inner circumferential face of the housing. Therefore, when the pump member is driven, no abrasive powder is generated from the sliding portion, and durability of the liquid supply device can be improved. Additionally, since no abrasive powder is generated from the sliding portion, even if the liquid such as a chemical liquid is directly discharged from the drive pump chamber to a member to be applied, no foreign substances can be mixed in the liquid to be applied.

Since the pump member is not subjected to the pressure in the pump member, an unnecessary form change of the pump member is not made, and a life time of the pump chamber becomes long, and the durability of the liquid supply device can be improved.

DESCRIPTION OF THE PREFERRED EMBODIMENTS

Figure 1:
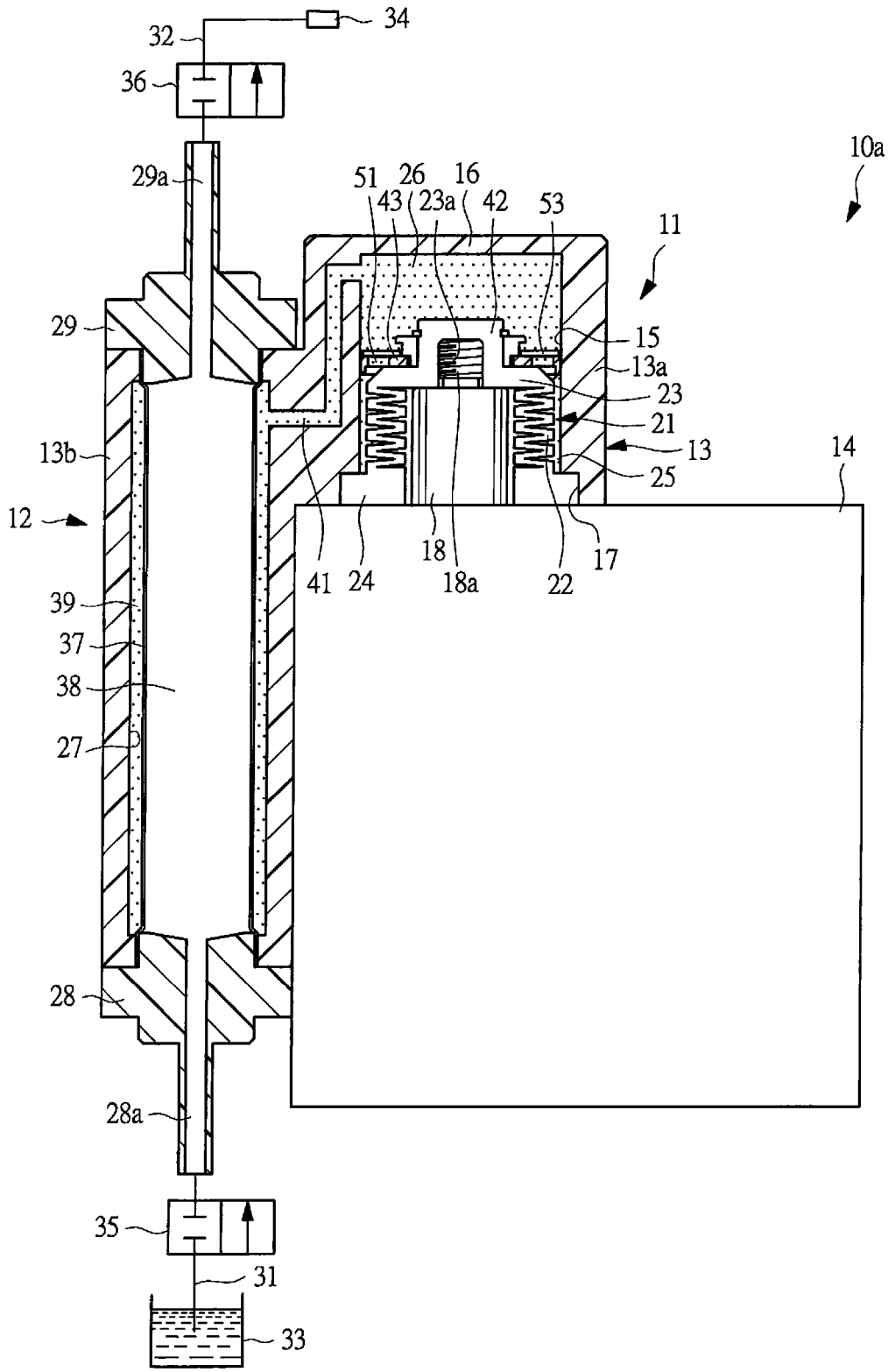
FIG. 1 is a sectional view showing a liquid supply device according to a first embodiment of the present invention that is in a resting state.

Embodiments according to the present invention will be detailed below based on the accompanying drawings. The same reference numerals are denoted to members common to the respective drawings.

Figure 2:
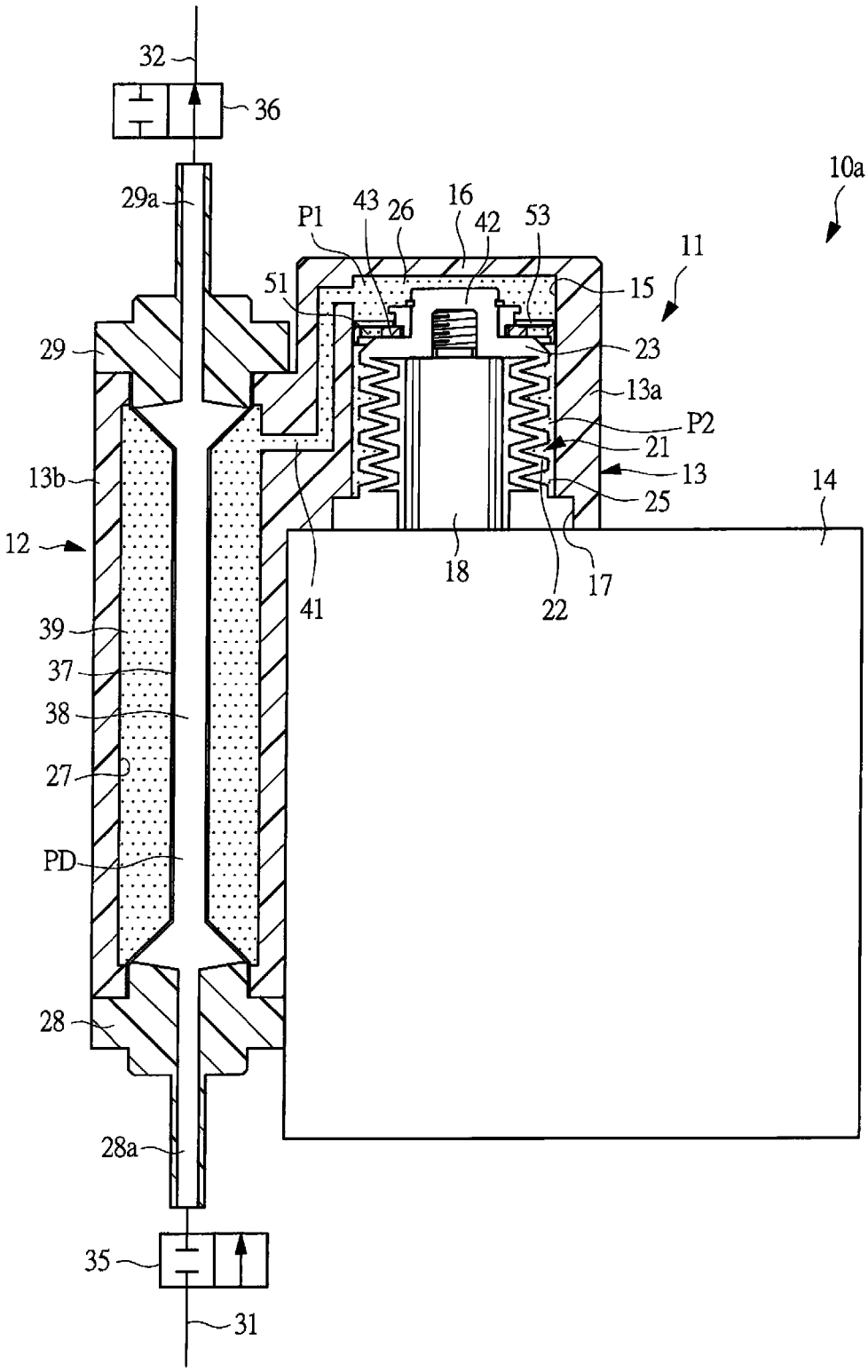
FIG. 2 is a sectional view showing the liquid supply device according to the first embodiment that is in a liquid discharging state.
Figure 3:
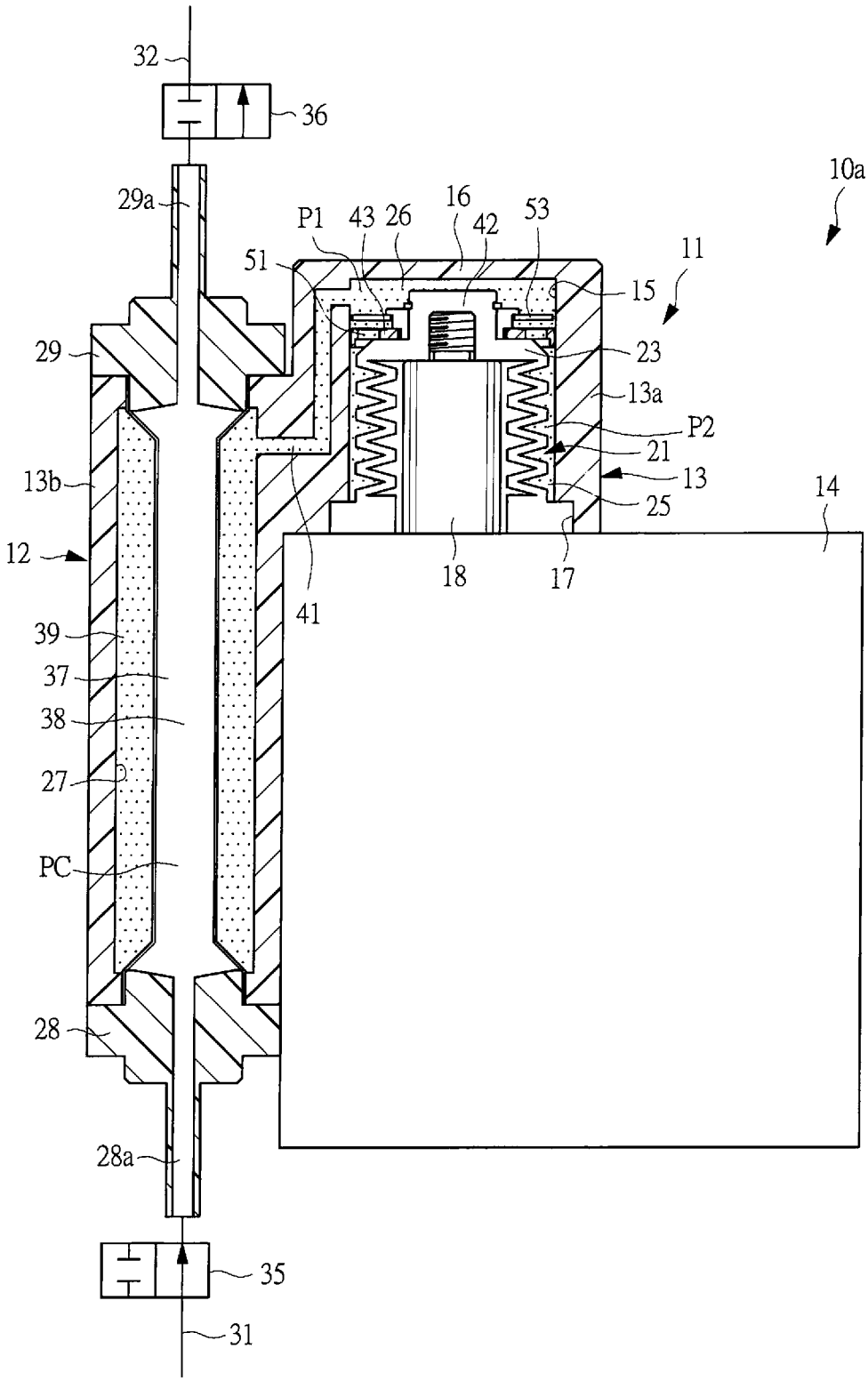
FIG. 3 is a sectional view showing the liquid supply device according to the first embodiment that is in a liquid sucking state.

A liquid supply device 10*a* shown in FIGS. 1 to 3 comprises a drive pump 11 and a liquid pump 12. The drive pump 11 has a housing 13*a* for drive, and the liquid pump 12 has a housing 13*b* for liquid. Both of the housings 13*a* and 13*b* are unitized to form a housing member 13, and the housing member 13 is attached to a drive unit 14. A cylindrical receiving hole 15 is formed inside the housing 13*a* for drive, and one end portion of the housing 13*a* is a blockage end closed by a blockage wall 16, and an opening portion 17 is formed in the other end of the housing 13*a*.

A drive rod 18 is linearly reciprocably mounted inside the housing 13*a*, and reciprocates by an unshown drive apparatus that comprises an electric motor or a pneumatic cylinder, etc. incorporated into the drive unit 14. Hereinafter, a movement directed toward the blockage wall 16 of the drive rod 18 is called a "forward movement", and a movement in a direction of separating from the blockage wall 16 is called a "backward movement".

Figure 4:
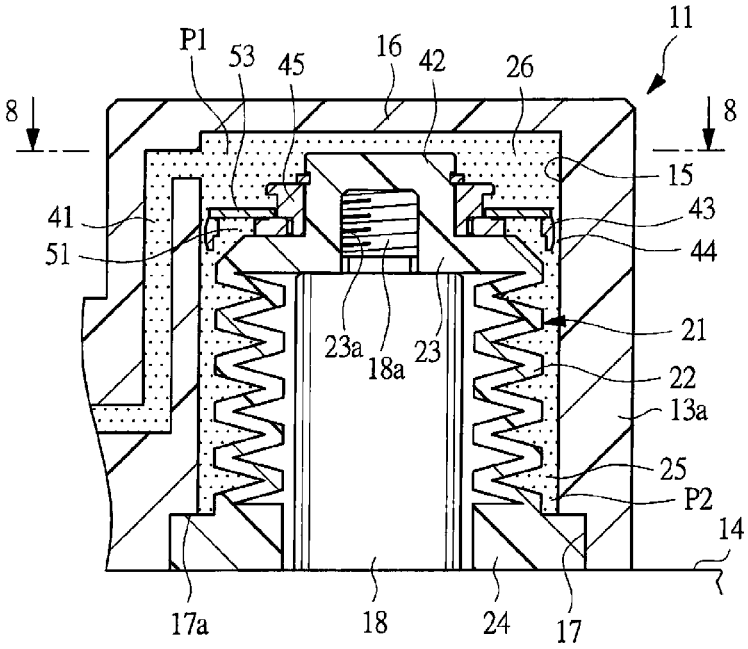
FIG. 4 is a sectional view shown by enlarging a part of FIG. 2.

Mounted in the housing 13*a* is a bellows 21 as a pump member. This bellows has, as shown in FIG. 4, an accordion-shaped portion 22, an end plate portion 23 provided to one end portion of the accordion-shaped portion 22, and a ring portion 24 provided to the other end portion of the accordion-shaped portion 22, wherein those members are shaped integrally from a fluorocarbon resin etc. A screw hole 23*a*, into which a male screw 18*a* provided at a tip portion of the drive rod 18 is screwed, is formed in the end plate portion 23, and the end plate portion 23 is fixed to the tip portion of the drive rod 18. Meanwhile, the ring portion 24 abuts on a stepped portion 17*a* formed around the opening portion 17 of the housing 13*a*, and is clipped between the drive unit 14 and the housing 13*a*.

In the bellows 21, when the drive rod 18 reciprocates axially, the end plate portion 23 is axially moved with the drive rod 18, and the accordion-shaped portion 22 is elastically deformed axially. A communication chamber 25 is formed between the bellows 21 and an inner circumferential face of the receiving hole 15 in the housing 13*a*. An inside of the bellows 21 communicates with an outside via an unshown escape hole formed in the drive unit 14, and ambient air flows inside the bellows 21 according to a reciprocation of the drive rod 18 and, simultaneously, air inside the bellows is exhausted exteriorly.

A region between the end plate portion 23 of the bellows 21 and the blockage wall 16 serves as a drive pump chamber 26 of the drive pump 11, and an inflow and outflow of a liquid occur between the drive pump chamber 26 and the communication chamber 25. When the drive rod 18 moves forward, the drive pump chamber 26 contracts, and the liquid inside the drive pump chamber 26 is discharged to an exterior of the housing 13*a*. Meanwhile, when the drive rod 18 moves backward, the drive pump chamber 26 expands, and a liquid flows into an interior of the drive pump chamber 26 from the outside.

As shown in FIGS. 1 to 3, a receiving hole 27 penetrating longitudinally is formed in the housing 13*b* for liquid, and an inflow-side joint member 28 is attached to a lower end portion of the housing 13*b*, and an outflow-side joint member 29 is attached to an upper end portion of the housing 13*b*. The respective joint members 28 and 29 form parts of the housing 13*b*. An inflow pipe 31 is connected to an inflow port 28*a* formed in the inflow-side joint member 28, and an outflow pipe 32 is connected to an outflow port 29*a* formed in the outflow-side joint member 29. The inflow pipe 31 is connected to a liquid container 33, and a tip of outflow pipe 32 is provided with a discharge nozzle 34 that applies the liquid. An opening/closing valve 35 that opens and closes a flow path located inside the inflow pipe 31 is provided to the inflow pipe 31, and an opening/closing valve 36 that opens and closes a flow path located inside the outflow pipe 32 is provided to the outflow pipe 32.

As shown in FIGS. 1 to 3, a flexible tube 37, which is made of a fluorocarbon resin etc. and is radially elastically deformable, is mounted as a partitioning film member in the housing 13*b*. An inflow end portion of the tube 37 is clipped between the housing 13*b* and the joint member 28, and an outflow end portion of the housing 13*b* is clipped between the housing 13*b* and the joint member 29. The inflow end portion of the tube 37 may be welded at the housing 13*b*, and its outflow end portion may be also welded similarly thereto. An interior of the housing 13*b* is partitioned by the tube 37 into a liquid pump chamber 38 inside the tube 37, and a drive chamber 39 outside it. The liquid pump chamber 38 communicates with the inflow port 28*a* and the outflow port 29*a*. The outflow port 29*a* is provided above the inflow port 28*a*, and both ports 28*a* and 29*a* are coaxial. For this reason, even if air bubbles are mixed in the liquid, they are prevented from remaining in the liquid pump chamber 38

The drive chamber 39 communicates with the drive pump chamber 26 by a communication hole 41 formed in the housing member 13, and a liquid is enclosed in the drive pump chamber 26, drive chamber 39, communication hole 41, and communication chamber 25. The enclosed liquid is represented by dots in Figures. When the drive rod 18 moves forward, the drive pump chamber 26 contracts, and the liquid in the drive pump chamber 26 is supplied to the drive chamber 39, whereby the drive chamber 39 expands and, accordingly, the tube 39 contracts radially. When the tube 37 is contracted, a flow path in the inflow pipe 31 is closed, as shown by FIG. 2, by the opening/closing valve 35, and when the flow path in the outflow pipe 32 is opened by the opening/closing valve 36, the liquid in the liquid pump chamber 38 is supplied to the discharge nozzle 34. Meanwhile, when the drive rod 18 is moved backward, the drive pump chamber 26 expands, and the liquid in the drive chamber 39 is sucked into the drive pump chamber 26, whereby the drive chamber 39 contracts and, accordingly, the tube 37 expands radially. When the tube 37 is expanded, the flow path in the inflow pipe 31 is opened, as shown in FIG. 3, by the opening/closing valve 36, and when the flow path in the outflow pipe 32 is closed by the opening/closing pipe 36, the liquid in the liquid container 33 is sucked into the liquid pump chamber 38.

In the liquid supply device 10*a*, the housing member 13 is provided with the drive pump 11 and liquid pump 12, but the drive pump 11 and liquid pump 12 may be separated. In this case, the drive pump chamber 26 and drive chamber 39 need to be connected by piping.

The liquid supply device 10*a* as shown in FIG. 1 is used when a discharge load exerted on the drive pump chamber 26 is larger than a suction load exerted on the drive pump chamber 26. At this time, the discharge load is exerted on the drive pump chamber 26 when the liquid in the liquid pump chamber 38 is discharged from the discharge nozzle 34 by the contraction of the tube 37 due to the forward movement of the drive rod 18, and a suction load is exerted on the drive pump chamber 26 when the liquid in the liquid container 33 is sucked into the liquid pump chamber 38 by the expansion of the tube 37 due to the backward movement of the drive rod 18. The discharge load becomes larger than the suction load when a distance from the outflow port 29*a* to the discharge nozzle 34 is larger than a distance from the inflow port 28*a* to the liquid container 33, or when discharge speed is fast, or when any member causing resistance such a filter exists between the liquid container and the discharge nozzle.

As shown in FIG. 1, under a state where the liquid supply device 10*a* becomes resting and the tube 37 expands radially outward, to contract the tube 37 by the forward movement of the drive rod 18, the drive pump chamber 26 needs to be pressurized by driving, for the forward movement, the drive rod 18 against the above-mentioned discharge load.

In contrast, to expand the tube 37 by sucking the liquid into the drive pump chamber 26 from the drive chamber 39, the suction load exerted on the drive pump chamber 26 is smaller than the discharge load.

Thus, when the tube 37 is contracted by moving forward the drive rod 18 against the discharge load, the drive rod 18 performs a drive operation, and when the drive rod 18 is moved backward, the drive rod 18 performs a return operation.

Figure 5:
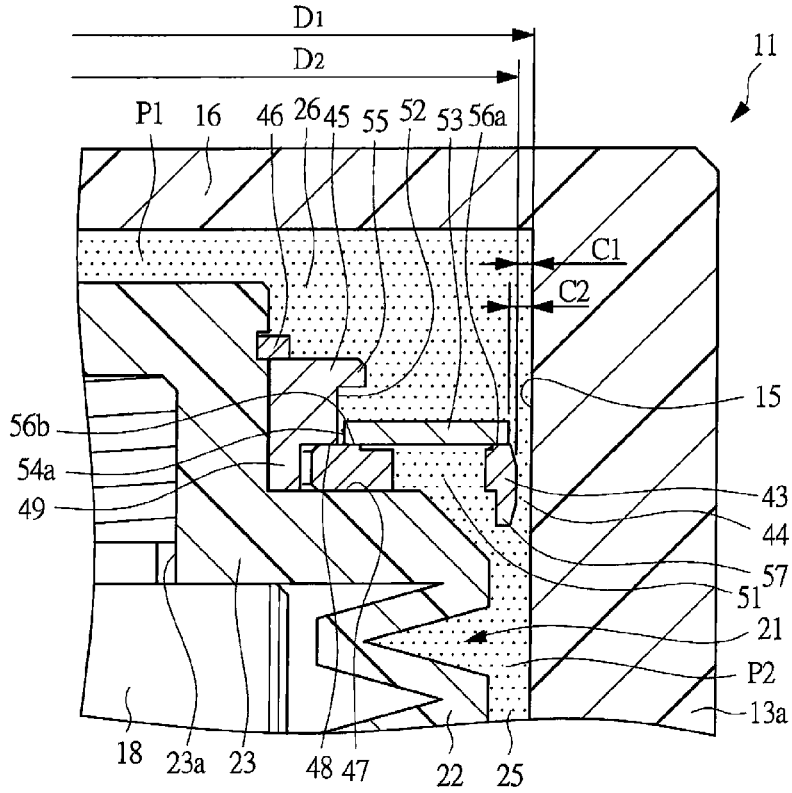
FIG. 5 is a sectional view shown by enlarging a part of FIG. 4.

As shown in FIGS. 4 and 5, the end plate portion 23 of the bellows 21 is provided with a valve holding portion 42 that protrudes toward the blockage wall 16, and an annular orifice member 43 is assembled into the valve holding portion 42. An outer diameter of the orifice member 43 is set slightly smaller than an inner diameter of the receiving hole 15. And, a communication gap 44, which causes the drive pump chamber 26 and the communication chamber 25 to slightly communicate with each other, is formed between an inner circumferential face of the receiving hole 15, i.e., an inner circumferential face of the housing 13*a* and an outer circumferential face of the orifice member 43. In any event of the drive operation time and the return operation time of the drive rod 18, the drive pump chamber 26 and the communication chamber 25 communicate with each other.

As shown in FIG. 5, the orifice member 43 is held on a tip portion side of the drive rod 18 by an annular valve guide 45 fixed to the valve holding portion 42, and the valve guide 45 is fixed to the valve holding portion 42 by a stopper ring 46. As shown in FIG. 5, a guide face 48 is formed radially on the valve guide 45, and the orifice member 43 is held between the guide face 48 and an end face 47 of the end plate portion 23 so that an axial-directional movement of the orifice member 43 is restricted. Further, the valve guide 45 is provided with a small-diameter portion 49 protruding toward the end face 47 from the guide face 48, and an outer diameter of the small-diameter portion 49 is set smaller than an inner diameter of the orifice member 43. Therefore, the orifice member 43 is held on a tip portion side of the drive rod 18 so as to move slightly radially without moving axially.

Figure 9:
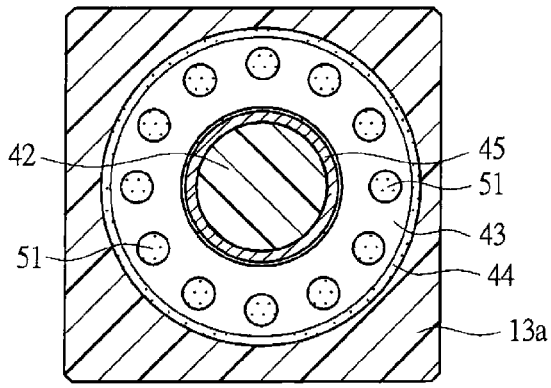
FIG. 9 is a sectional view taken along line 9-9 in FIG. 6.
Figure 10:
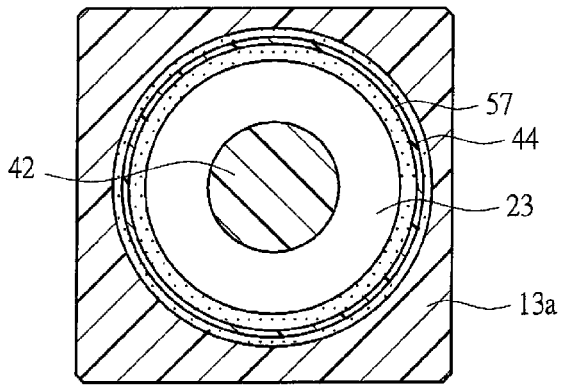
FIG. 10 is a sectional view taken along line 10-10 in FIG. 6.

As shown in FIGS. 5 and 9, a plurality of through holes 51 spaced in a circumferential direction are formed in the orifice member 43. A valve member 53 formed of an annular plate material is disposed near the orifice member 43, and the valve member 53 is axially movable with respect to a guide portion 52 of the valve guide 45. When the valve member 53 contacts with valve seating faces 56*a* and 56*b* of the orifice member 43, the through holes 51 are closed by the valve member 53. Meanwhile, when the valve member 53 is separate from the orifice member 43, the through holes 51 are opened or released so that the communication chamber 52 and drive pump chamber 26 become communicating with each other via the through holes 51.

The valve member 53 blocks the through holes 51 formed in the orifice member 43 when the drive rod 18 is moved forward, and releases the through holes 51 when the drive rod 18 is moved backward. Accordingly, in causing the drive rod 18 to move forward to drive the drive pump chamber 26 for pressurization by the bellows 21, the through holes 51 become closed by the valve member 51. Since the communication chamber 25 only communicates with the drive pump chamber 26 via the communication gap 44, even if the heavy loads are applied to the tube 37, a pressure in the drive pump chamber 26 is made high, and a rise of the pressure in the communication chamber 25 is prevented. For this reason, even if the heavy discharge load is applied to the drive pump chamber 26, the bellows 21 is prevented from deforming radially.

Meanwhile, in causing the drive rod 18 to move backward to suck the liquid into the drive pump chamber 26 from the drive chamber 39 by the bellows 21, the through holes 51 are opened or released by the valve member 53. However, the suction load is not heavy, and a difference in pressure between the communication chamber 25 in a negative pressure state and an interior of the bellows 21 in an atmospheric state is small, so that the bellows 21 is prevented from deform radially.

Figure 8:
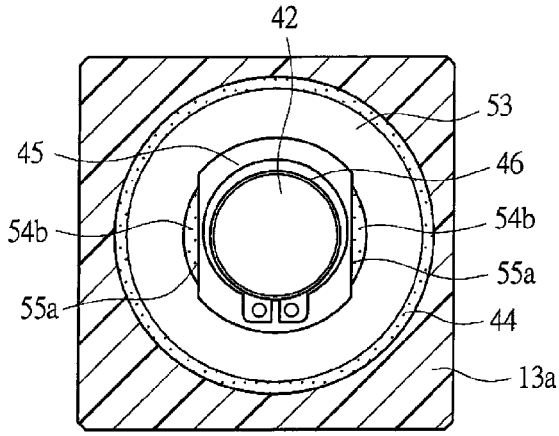
FIG. 8 is a sectional view taken along line 8-8 in FIG. 4.

The outer diameter of the valve member 53 is smaller than the outer diameter of the orifice member 43 and, as shown in FIG. 5, a gap "C2" between the outer circumferential face of the valve member 53 and the inner circumferential face of the receiving hole 15 is set larger than a dimension "C1" of he communication gap 44. Further, the inner diameter of the valve member 53 is set larger than an outer diameter of the guide portion 52, and an auxiliary gap 54*a* is formed between the valve member 53 and the guide portion 52. The auxiliary gap 54*a* causes the communication chamber 25 and drive pump chamber 26 to communicate with each other via the through holes 51 when the valve member 53 is separate from the orifice member 43. To restrict a position where the valve member 53 is separate from the orifice member 43, the end portion of the valve guide 45 is provided with a stopper 55 which is larger in diameter than the guide portion 52. As shown in FIG. 8, formed at the stopper 55 are notch portions 55*a*, and notch gaps 54*b* that communicate with the auxiliary gap 54*a* by the notch portion 55*a*. Therefore, when the valve member 53 abuts on the stopper 55, the drive pump chamber 26 and communication chamber 25 become communicating with each other via the notch gaps 54*b*.

As shown in FIG. 5, valve seating faces 56*a* and 56*b*, with which the valve member 53 contacts, are formed into annular shapes at outer and inner circumferential portions of the orifice member 43, and a face between the valve seating faces 56*a* and 56*b* does not contact with the valve member 53. By causing the valve member 53 to contact only with the valve seating faces 56*a* and 56*b*, the valve member 53 can be smoothly separate from the orifice member 43. As shown in FIG. 5, an annular protrusion 57 is provided at an outer circumferential portion of a back face of the orifice member 43, which is opposite to the valve member 53, and an axial-directional dimension of the communication gap 44 is set larger than a plate thickness of the orifice member 43. As shown in FIG. 5, a taper face inclining radially inward toward a tip face of the protrusion 57 including a portion of the protrusion 57 is formed on an outer circumferential face of the orifice member 43.

In the above-mentioned liquid supply device 10*a*, as shown in FIG. 5, if an inner diameter dimension of the inner circumferential face of the housing 13*a* is "D1", and an outer diameter dimension of the orifice member 43 is "D2", the inner diameter dimension D1 is set at 38 mm (dimensional tolerance of 0.01 mm), and the outer diameter dimension D2 is set at 37.9 mm (dimensional tolerance of 0.005 mm). Accordingly, a difference between the outer and inner diameter dimensions D2 and D1 becomes 0.1 mm, and a gap dimension "C1" of the communication gap 44 is set at 0.05 mm. Further, a length of a linear part of the communication gap is set at 1.63 mm. If a dimensional difference between the outer and inner diameter dimensions D2 and D1 increases up to approximately 0.15 mm, a pressure in the communication chamber 25 also varies due to variation of a pressure in the drive pump chamber 26. However, when the dimensional difference is set at 0.1 mm or less, even if the pressure in the drive pump chamber 26 rises, the pressure in the communication chamber 25 has hardly risen.

When a discharge flow rate for discharging the liquid in the drive pump chamber 26 into the drive chamber 39 was set at 0.1 ml/s (0.1 milliliter a second), the pressure variation in the communication chamber 25 occurred due to the pressure variation in the drive pump chamber 26. However, when the discharge flow rate was set at 0.5 ml/s or more, the valve member 53 certainly blocked the through holes 51 of the orifice member 43, so that the pressure variation in the communication chamber 25 did not occur due to the pressure variation in the drive pump chamber 26.

The liquid supply device 10*a* shown in FIGS. 1 to 10 is an indirect operation type of having the drive pump 11 and the liquid pump 12, and expanding and contracting the drive pump chamber 26 to use the liquid enclosed therein as an indirect medium and to drive the liquid pump 12. Further, this liquid supply device 10*a* becomes in actuation form in which the discharge load is heavier than the suction load. Therefore, a pressure difference between an atmospheric pressure inside the bellows 21 and the pressure in the drive pump chamber 26 at the discharge of the liquid from the discharge nozzle 34 is larger than a pressure difference between the atmospheric pressure and that at the suction of the liquid in the liquid container 33 into the liquid pump chamber 38.

To activate the liquid supply device 10*a* to supply to the discharge nozzle 34 the liquid such as photoresist or purified water supplied into the liquid pump 38 from the liquid container 33, the drive rod 18 is moved forward as shown in FIG. 2, i.e., is moved so as to protrude toward the blockage wall 16, and the liquid in the drive pump chamber 26 is discharged to the drive chamber 39 via the communication hole 41. When the drive rod 18 is moved forward, the bellows 21 lengthens axially, whereby a volume of the communication chamber 25 becomes large.

At this time, the discharge load is applied to the drive pump chamber 26, and the drive rod 18 becomes a drive operation of pressurizing the drive pump chamber 26. As shown in FIGS. 4 and 5, at its drive operation time, the liquid in the drive pump chamber 26 is choked via the communication gap 44 to flow in the communication chamber 25, and the valve member 53 closely contacts with the orifice member 43 by the liquid in the drive pump chamber 26 that has been pressurized, and the through holes 51 are blocked. At the drive operation time, since the liquid from the drive pump chamber 26 is choked and flows in the communication chamber 25, a pressure rising in the communication chamber 25 is suppressed due to a pressure loss occurring when the liquid flows via the communication gap 44 that is long axially. Namely, if the pressure in the liquid pump chamber 38 is "PD", that in the drive pump chamber 26 "P1", and that in the communication chamber 25 "P2", then the pressure P1 in the drive pump chamber 26 becomes nearly equal to the pressure PD, whereas the pressure P2 in the communication chamber 25 becomes lower than the pressures PD and P1.

Thus, at the drive operation time, the communication chamber 25 communicates with the drive pump chamber 26 via the communication gap 44 only, and the pressure rising of the communication chamber 25 is suppressed by the pressure loss due to a choking operation, so that the accordion-shaped portion 22 of the bellows 21 is prevented from elastically deforming toward its radial-directional inside at the drive operation time. Therefore, when the drive rod 18 starts moving forward, the pressure in the drive pump chamber 26 rises immediately, whereby the liquid pump chamber 38 is contracted immediately, and a rising characteristic of the liquid pump 12 can be improved. Further, since the deformation of the accordion-shaped portion 22 of the bellows 21 is prevented, a discharge property of the liquid from the outflow port 29*a* of the liquid pump 12 is linearly changed according to a stroke of the drive rod 18. Namely, when the accordion-shaped portion 22 of the bellows 21 deforms radially, the stroke of the drive rod 18 may not be proportional to an amount of liquid fed to the drive chamber 39. However, the liquid supply device according to the present invention is not true of the above. Further, durability of the bellows 21 can be enhanced.

To move the drive rod 18 backward to supply the liquid to the liquid pump chamber 38 from the liquid container 33, as shown in FIG. 3, the drive rod 18 is moved backward toward a direction of separating from the blockage wall 16, and the liquid in the drive chamber 39 is supplied to the drive pump chamber 26.

Figure 6:
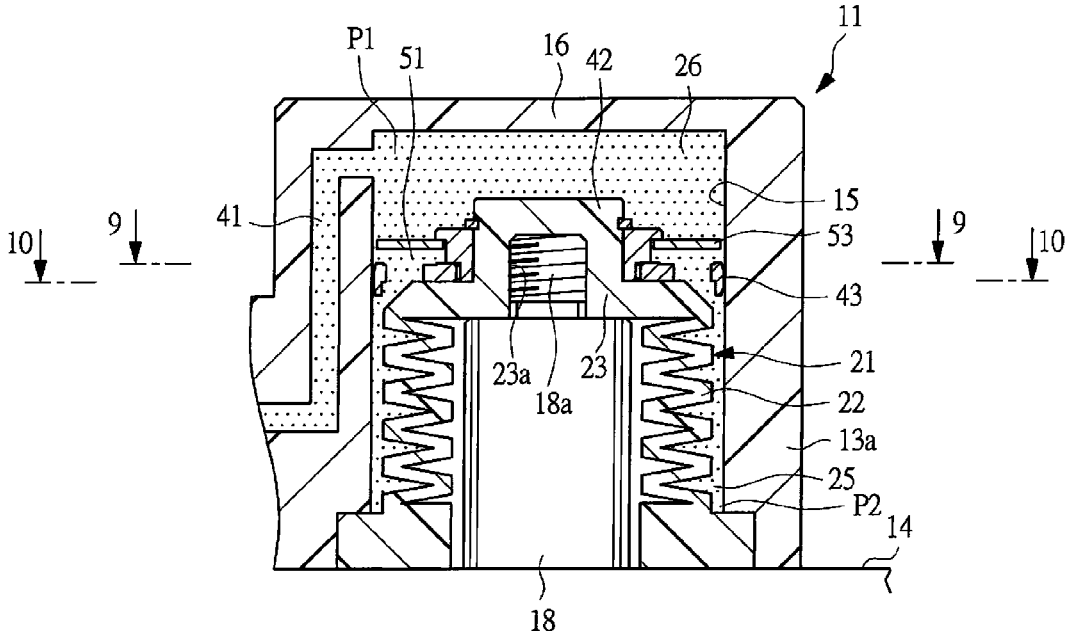
FIG. 6 is a sectional view shown by enlarging a part of FIG. 3.
Figure 7:
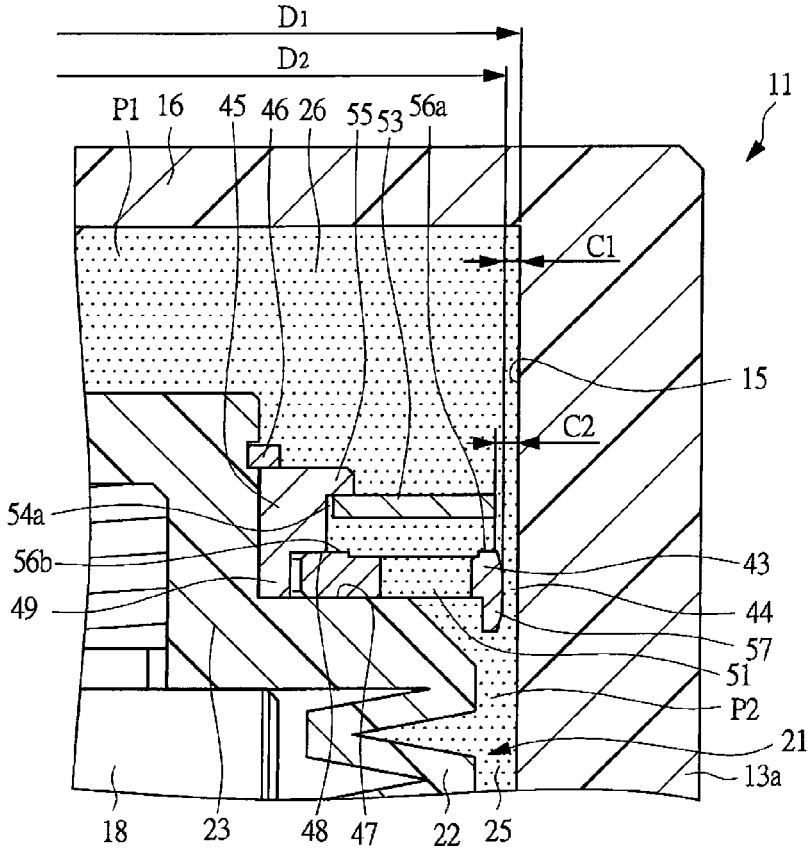
FIG. 7 is a sectional view shown by enlarging a part of FIG. 6.

At the return operation time described above, since the suction load is not heavy, a negative pressure in the drive pump chamber 26 becomes close to the atmospheric pressure. As shown in FIGS. 6 and 7, at this return operation time, the valve member 53 separates from the orifice member 43, whereby the through holes 51 are opened, and the auxiliary gaps 54*a* are opened by the notch gaps 54*b*. Therefore, the pressure P2 in the communication chamber 25 is nearly equal to the pressure P1 in the drive pump chamber 26. Accordingly, when the drive rod 18 moves backward, the bellows 21 is not elastically deformed radially.

Figure 11:
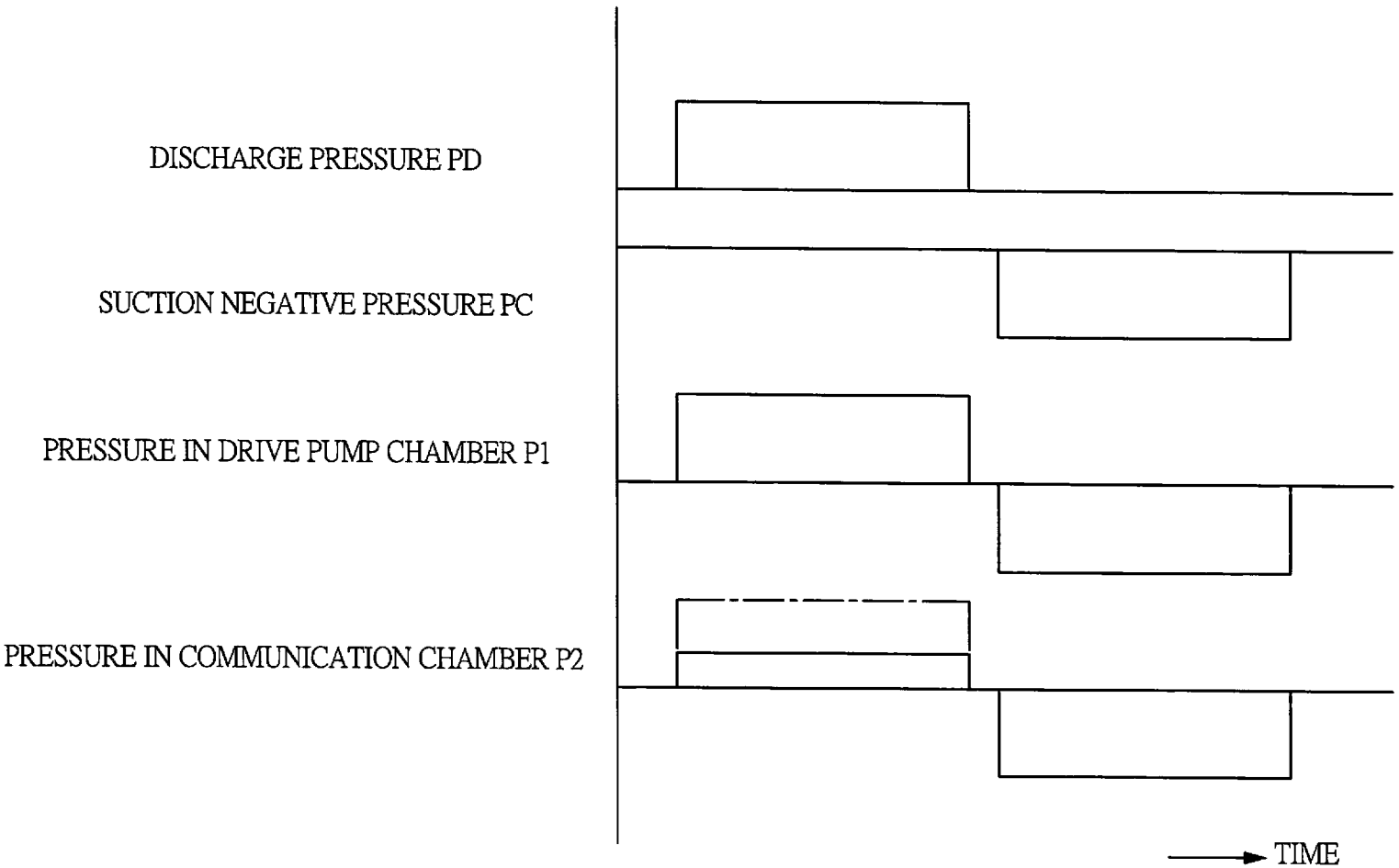
FIG. 11 is a characteristic line diagram showing changes in pressures in a drive pump chamber and a communication chamber at a drive operation time and a return operation time in the liquid supply device according to the present invention.
Figure 12A:
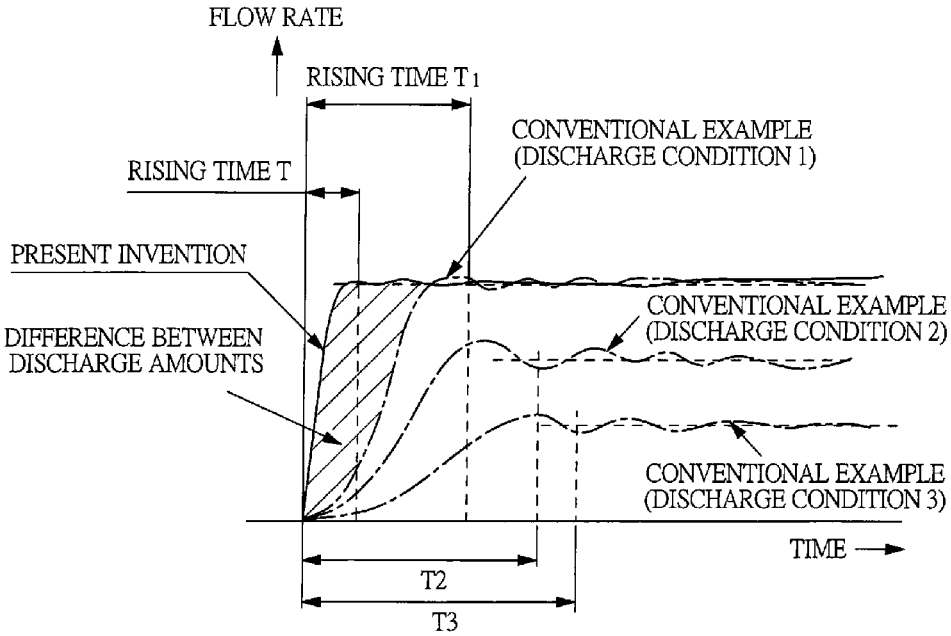
FIG. 12A is a characteristic line drawing showing a rising characteristic of the liquid supply device according to the present invention.

FIG. 11 is a characteristic line diagram showing each change in the pressures in the drive pump chamber 26 and the communication chamber 25 at the drive operation time and the return operation time in the liquid supply device 10*a*; and FIG. 12A is a characteristic line drawing showing a rising characteristic of the liquid supply device 10*a* as compared with a conventional example.

As shown in FIG. 11, when the liquid is discharged from the liquid pump chamber 38, the pressure P1 in the drive pump chamber 26 becomes high correspondingly to the discharge pressure PD, and the pressure P2 in the communication chamber 25 is choked by the orifice member 43 and becomes lower than the pressure P1. A dash-single-dot line in FIG. 11 shows a pressure in a conventional communication chamber 25 exemplified as a comparative example. When the orifice member 43 is not provided, the pressure in the communication chamber 25 at the discharge time of the liquid is the same as the pressure in the drive pump chamber 26, and the bellows 21 elastically deforms radially.

For this reason, in a conventional technique as shown by dash-single-dot lines in FIG. 12A, the bellows elastically deforms at a time of starting activating the drive rod 18, and a rising time of the liquid discharged from the liquid pump chamber 38 has become long. In contrast, a rising characteristic of the liquid by the liquid supply device 10*a* according to the present invention has been improved. As shown by the dash-single-dot lines in FIG. 12A, in the conventional liquid supply device, when discharge conditions such as a discharge pressure, a flow rate, and an acceleration conditions are changed based on "discharge conditions 1 to 3", the rising time varied at T1 to T3. In the liquid supply device 10*a*, however, even if the discharge conditions are changed, there is no change in the rising time T. When the rising time is changed to T or T1, a total discharge amount represented by a hatched area is a difference between total discharge amounts at the rising times after the liquid supply device is activated. The total discharge amount is calculated by a product of the rising time and a flow rate of the liquid per unit time.

The total pressure-loss is made heavy when the liquid in the drive pump chamber 26 has heavy viscosity, when a discharge speed of the liquid from the drive pump chamber 26 is made high by the drive rod 18, and when a discharge flow path guiding the liquid has large resistance. In such a case, a withstanding pressure, i.e., rigidity of the pump head portion including the bellows affects a rising characteristic at a discharge start time. When the accordion-shaped portion 22 of the bellows 21 is subjected to a pressure load at an operation start time, and is significantly deformed momentarily, such deformation results in a decrease in a cross section area of the bellows 21, and a decrease in a flow rate at a rising time, and further may become a factor of causing a damping phenomenon (flow rate variation). Those become dead zones at the discharge start time, and affects deterioration of the rising time.

An amount of deformation of the bellows becomes large in a case of the heavy discharge pressure load such as the high viscous liquid, the fast flow rate, and the fast acceleration. Accordingly, an effective cross-section area of the bellows is decreased until completion of the discharge activation. Therefore, the discharge flow rate decreases, as a result of which a discharge amount at one shot cannot be discharged as set previously. Namely, since liquid viscosity, discharge pressure, and pump drive conditions etc. significantly affect the discharge amount, accuracy of the discharge does not stabilize consequently.

However, in the liquid supply device 10*a* according to the present invention, the valve member for preventing a reverse flow and orifice resistance by the orifice member are subjected to a momentary influence on the discharge pressure, and the rising characteristic that is also a defect of a bellows structure is improved, and stabilization of the flow rate over the entire area can be achieved.

FIGS. 13 to 16 are sectional views showing a liquid supply device 10*b* according to another embodiment of the present invention. The liquid supply device 10*b* is used when the suction load applied to the drive pump chamber 26 is larger than the discharge load applied to the drive pump chamber 26. In this case, the suction load is applied to the drive pump chamber 26 when the tube 37 is expanded by a backward movement of the drive rod 18 and when the liquid in the liquid container 33 is sucked into the liquid pump chamber 38, and the discharge load is applied to the drive pump chamber 26 when the bellows 21 is contracted by a forward movement of the drive rod 18 and when the liquid in the liquid pump chamber 38 is discharged from the discharge nozzle 34. When a length from the outflow port 29*a* to the discharge nozzle 34 is shorter than a length from the inflow port 28*a* to the liquid container 33, or when suction speed is fast, or when there is anything serving as resister such as a filter provided between the inflow port and the liquid container, the suction load is heavier than the discharge load.

Accordingly, when the liquid is discharged from the liquid pump chamber 38 to the discharge nozzle 34, the heavy discharge load is not applied to the drive pump chamber 26. In contrast, when the liquid pump chamber 38 is expanded by the backward movement of the drive rod 18, the liquid in the drive chamber 39 needs to be sucked into the drive pump chamber 26 by driving and moving backward the drive rod 18 against the heavy suction load. At this time, the negative pressure in the drive pump chamber 26 is larger than that in the above-mentioned liquid supply device 10*a*. Thus, in the liquid supply device 10*b* applied when the suction load is heavier than the discharge load, the drive rod 18 becomes a drive operation when it is moved backward, and the drive rod 18 becomes a return operation when it is moved forward.

Figure 15:
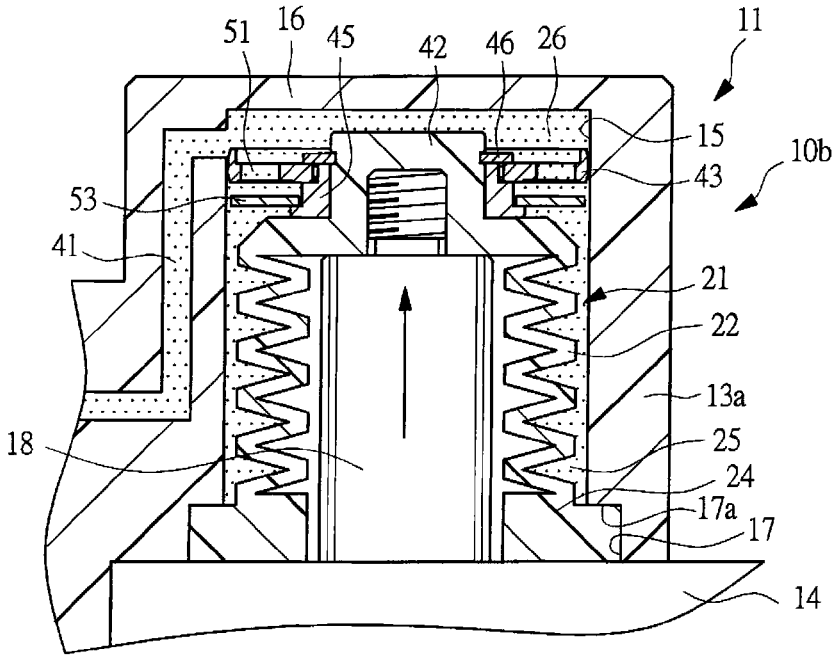
FIG. 15 is a sectional view shown by enlarging a part of FIG. 13.
Figure 16:
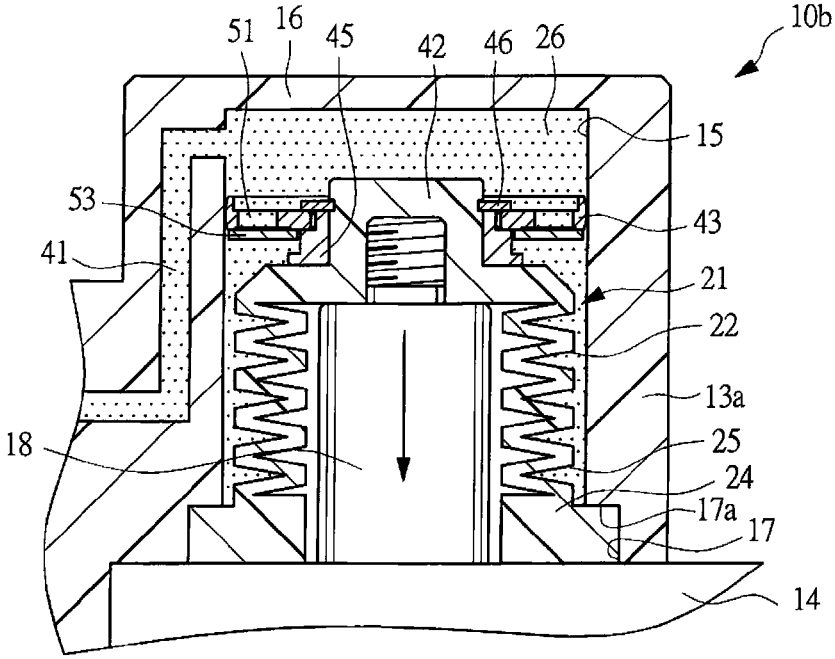
FIG. 16 is a sectional view shown by enlarging a part of FIG. 14.

As shown in FIGS. 15 and 16, unlike the above-mentioned liquid supply device 10*a*, the orifice member 43 and the valve member 53 are disposed in axially reversed states in the valve holding portion 42. Namely, the valve member 53 is disposed between the orifice member 43 and the end face 47 of the bellows 21. Accordingly, when the drive rod 18 is moved backward, the through holes 51 are blocked by the valve member 53, and when the drive rod 18 is moved forward, the through holes 51 are opened by the valve member 53. Under a state of moving backward the drive rod 18 to close the through holes 51, the drive pump chamber 26 is driven for suction by the bellows 21 serving as a pump member. Meanwhile, when the drive rod 18 is moved forward, the liquid in the communication chamber 25 flows or is guided via the through holes 51 into the drive pump chamber 26.

When the drive pump chamber 26 becomes in a negative pressure at the drive operation time of moving the drive rod 18 backward, the through holes 51 are blocked, as shown in FIG. 16, by the valve member 53. Therefore, the drive pump chamber 26 and the communication chamber 25 become in a communication state only through the communication gap 44, and the liquid is choked by the communication gap 44. For this reason, the negative pressure in the drive pump chamber 26 is not propagated to the communication chamber 25, and the bellows 21 is not deformed radially at the drive operation time of sucking the liquid into the liquid pump chamber 38.

Figure 12B:
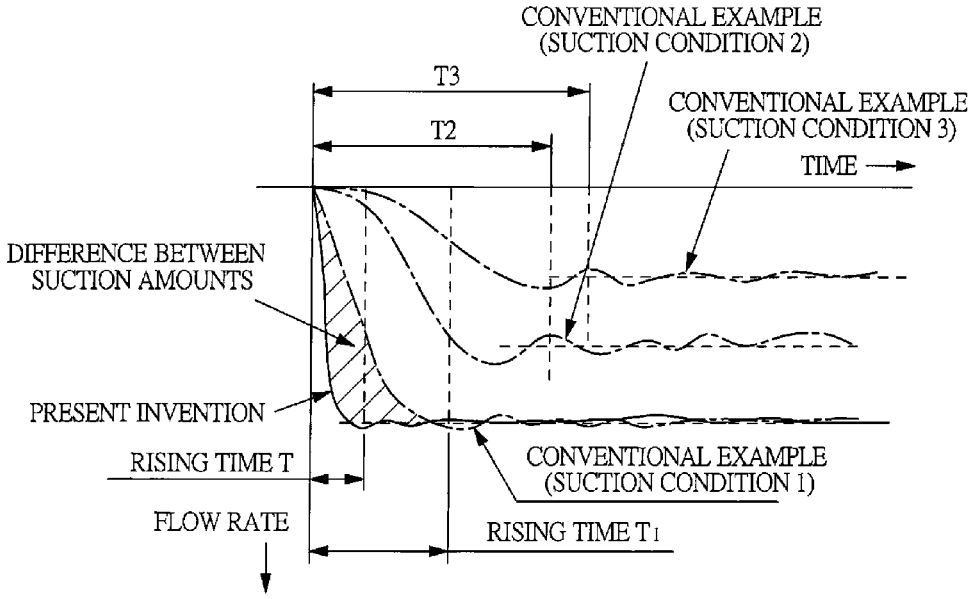
FIG. 12B is a characteristic line drawing showing the rising characteristic of the liquid supply device according to the present invention.
Figure 13:
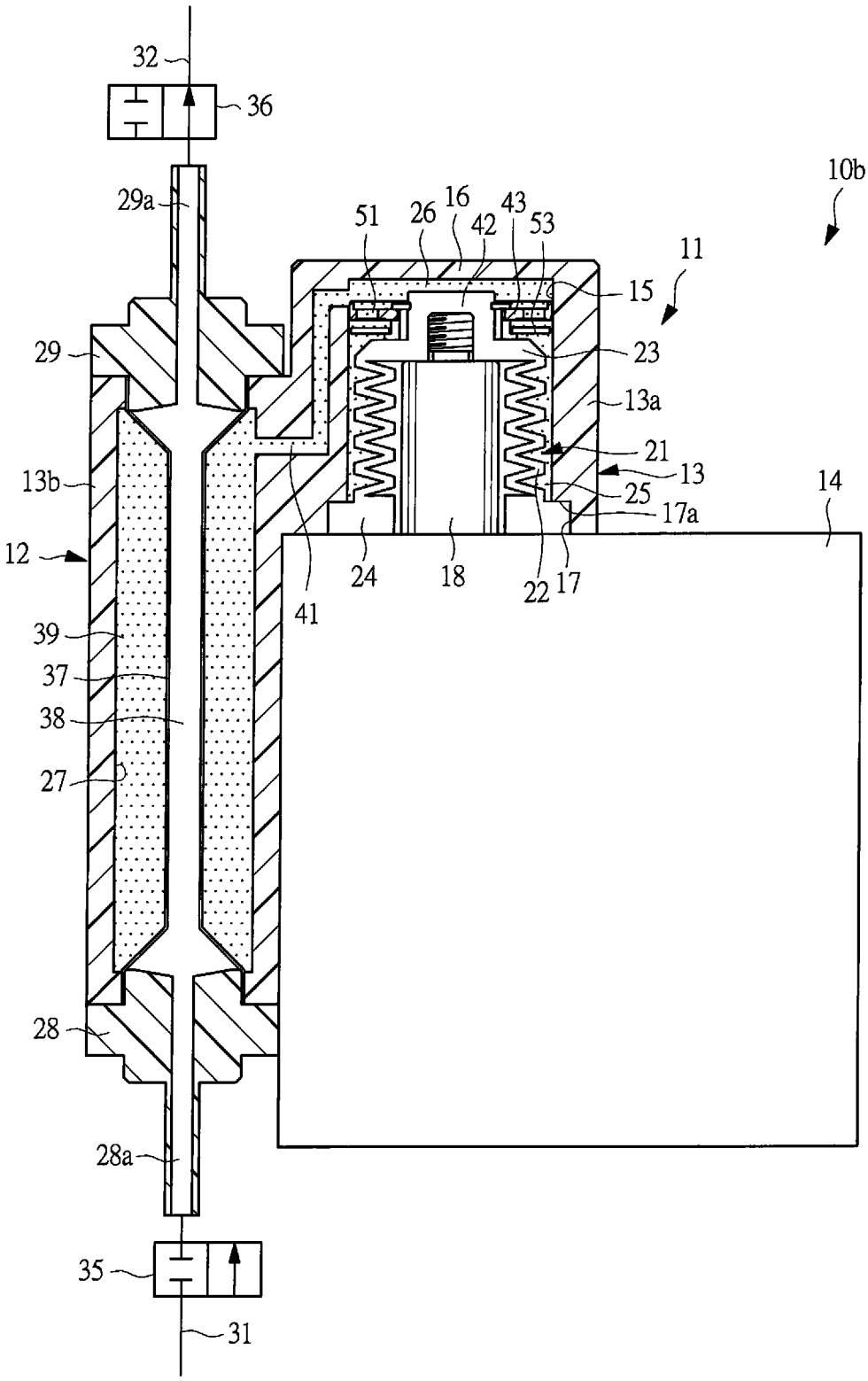
FIG. 13 is a sectional view showing a liquid supply device according to a second embodiment of the present invention that is in a liquid discharging state.
Figure 14:
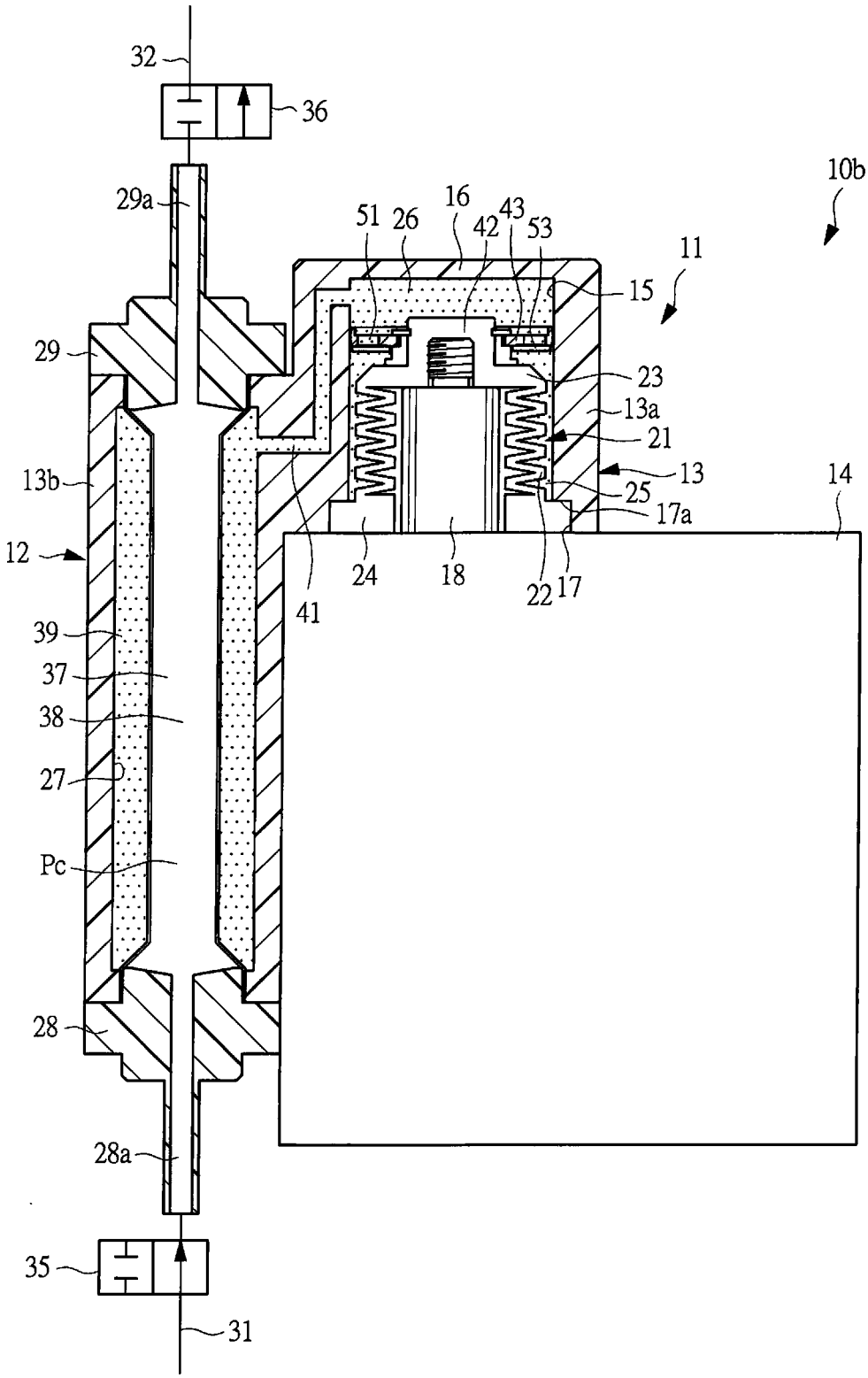
FIG. 14 is a sectional view showing the liquid supply device according to the second embodiment of the present invention that is in a liquid sucking state.

FIG. 12B is a characteristic line drawing showing the rising characteristic of the liquid supply device 10*b* as compared with the conventional example. In the conventional example, as shown by dash-single-dot lines in FIG. 12B, at the suction operation time of the drive rod 18 by the elastic deformation of the bellows, the bellows is elastically deformed, and the rising time of the liquid sucked into the liquid pump chamber 38 becomes lengthened. In contrast, the rising characteristic in the liquid supply device 10*b* according to the present invention is improved. As shown by the dash-single-dot lines in FIG. 12B, in the conventional liquid supply device, when a suction condition such suction pressure, flow rate, acceleration conditions is varied based on "conditions 1 to 3", a rising time is changed from T1 to T3. In the liquid supply device 10*b*, however, even if the suction condition is varied, the rising time T remains unchanged. When the rising time varies at T or T1, a suction amount represented by a hatched area shown in FIG. 12B becomes a difference between the suction amounts at the rising times when the liquid supply device is activated. The suction amount is calculated by a product of the flow rate of the liquid a second and the rising time.

Thus, in the liquid supply device 10*b*, even when the suction load is applied to the bellows 21 that is activated for suction, the valve member for preventing the reverse flow and the orifice resistance are subjected to the momentary influence on the suction pressure, and the rising characteristic that is also a defect of the bellows structure is improved, and the stabilization of the flow rate can be achieved over the entire area.

Figure 17:
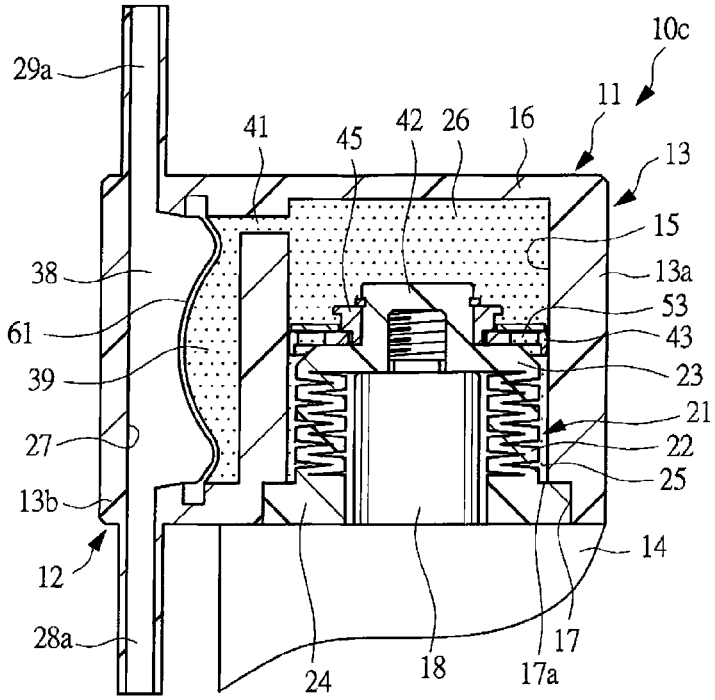
FIG. 17 is a sectional view showing a part of a liquid supply device according to a third embodiment of the present invention.

FIG. 17 is a sectional view showing a liquid supply device 10*c* according to another embodiment of the present invention. The liquid supply device 10*c* is different from the embodiment described above, and has a structure in which a partition film member is formed by an elastically deformable diaphragm 61 instead of the tube 37. The receiving hole 27 in the housing 13*b* is partitioned into the drive chamber 39 and the liquid pump chamber 38 by the diaphragm 61. Accordingly, when the diaphragm 61 deforms in a direction of contracting the liquid pump chamber 38, the liquid in the liquid pump chamber 38 is discharged from the discharge nozzle 34 via the outflow port 29*a*, and when the diaphragm 61 deforms in a direction of expanding the liquid pump chamber 38, the liquid in the liquid container 33 is sucked into the liquid pump chamber 38 via the inflow port 28*a*. Note that in an embodiment shown in FIG. 17, the above-mentioned joint members 28 and 29 are not provided, and the inflow port 28*a* and the outflow port 29*a* are formed integrally with the housing 13*b*.

This liquid supply device 10*c* is used, similarly to the liquid supply device 10*a* shown in FIG. 1, when the discharge load applied to the drive pump chamber 26 is heavier than the suction load applied to the drive pump chamber 26. In this case, the discharge load is applied to the drive pump chamber 26 when the liquid in the liquid pump chamber 38 is discharged from the discharge nozzle 34 by the forward movement of the drive rod 18, and the suction load is applied to the drive pump chamber 26 when the liquid in the liquid container 33 is sucked into the liquid pump chamber 38 by the backward movement of the drive rod 18. Accordingly, a location relation between the orifice member 43 and the valve member 53 is similar to that of the liquid supply device 10*a* shown in FIGS. 1 to 10.

Figure 18:
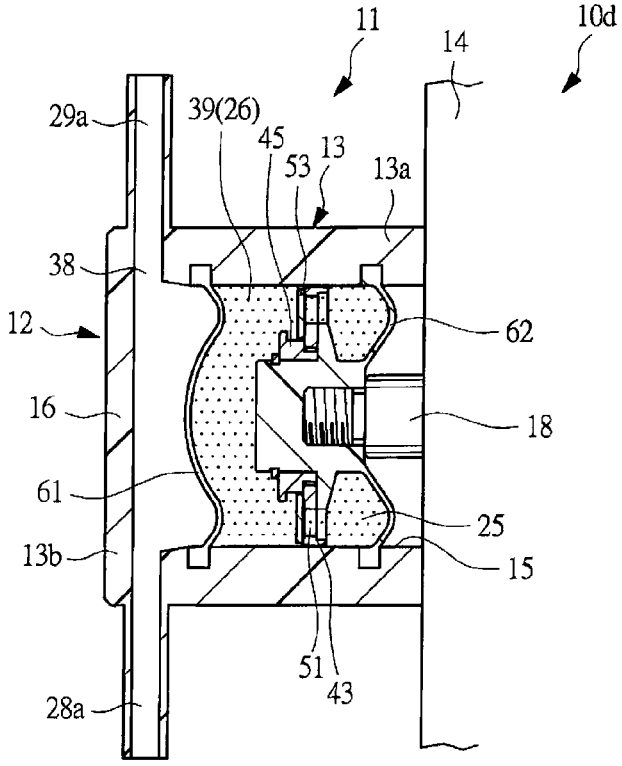
FIG. 18 is a sectional view showing a part of a liquid supply device according to a fourth embodiment of the present invention.

FIG. 18 is a sectional view showing a liquid supply device 10*d* according to still another embodiment of the present invention. Used as a pump member of the drive pump 11 in the liquid supply device 10*d* is a diaphragm 62 instead of the above-mentioned bellows 21. The diaphragm 62 elastically deforms axially according to an axial-directional movement of the drive rod 18. The liquid pump 12 uses the diaphragm 61 as a partition film member similarly to that of the liquid supply device 10*c* shown in FIG. 17. In the liquid supply device 10*d*, both of the diaphragms 61 and 62 are incorporated into the receiving hole 15 formed in the housing 13*a*. Accordingly, in the liquid supply device 10*d*, the drive pump chamber 26 and the drive chamber 39 are unified, whereby the entire size including the drive pump 11 and the liquid pump 12 can be miniaturized.

Similarly to the liquid supply device 10*d* shown in FIG. 17, the liquid supply device 10*d* shown in FIG. 18 is also used when the discharge load is heavier than the suction load. However, in using each of the liquid supply devices 10*c* and 10*d* when the suction load is heavier than the discharge load, the orifice member 43 and the valve member 53 are in axially reversed states and are disposed at the valve holding portion 42. Namely, the valve member 53 is disposed between the orifice member 43 and the end face 47 of the bellows 21.

Figure 19:
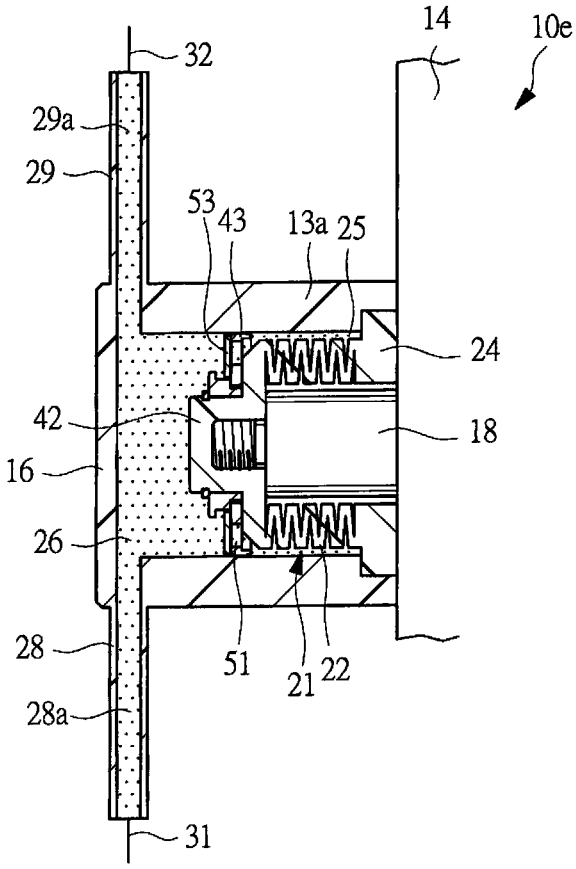
FIG. 19 is a sectional view showing a part of a liquid supply device according to a fifth embodiment of the present invention.

FIG. 19 is a sectional view showing a liquid supply device 10*e* according to yet another embodiment of the present invention. This liquid supply device 10*e* is a direct operation type of supplying the liquid to the discharge nozzle by the drive pump 11, whereas each of the above-mentioned liquid supply devices 10*a* to 10*d* is an indirect operation type of using as a drive source an indirect liquid driven by the drive pump 11 to drive the liquid pump 12. A structure of the drive pump 11 is similar to that of the above-mentioned liquid supply device 10*a*.

Figure 20:
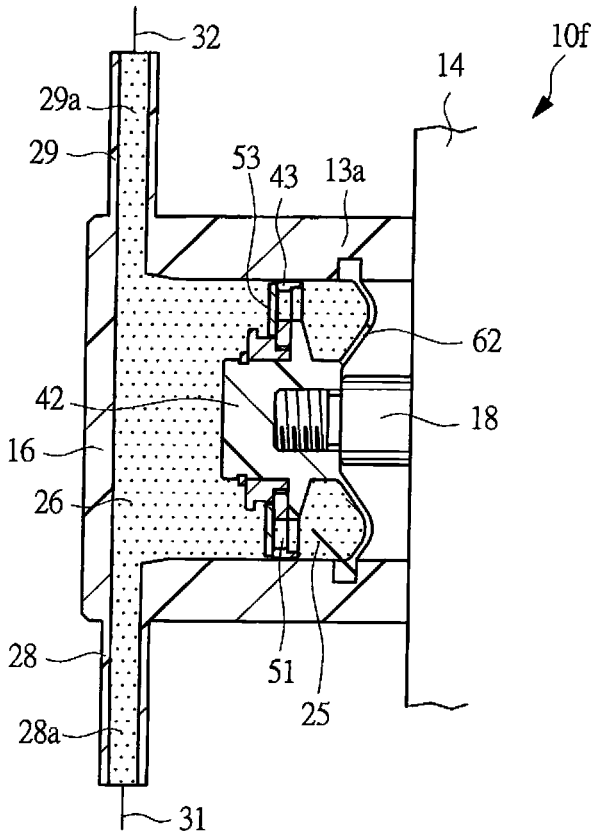
FIG. 20 is a sectional view showing a part of a liquid supply device according to a sixth embodiment of the present invention.

FIG. 20 is a sectional view showing a liquid supply device 10*f* according to yet still another embodiment of the present invention. The liquid supply device 10*f* is also the direct operation type similarly to that shown in FIG. 19, and the liquid supplied into the drive pump chamber 26 from the liquid container is supplied toward the discharge nozzle. In the liquid supply device 10*f* shown in FIG. 20, the diaphragm 62 similar to that in the liquid supply device 10*d* shown in FIG. 18 is used as a pump member, and the diaphragm 62 elastically deforms axially.

The inflow-side joint member 28 and the outflow-side joint member 29 in each of the liquid supply devices 10*e* and 10*f* shown in FIGS. 19 and 20 are provided integrally with the housing 13*a*, and the inflow port 28*a* and the outflow port 29*a* communicate with the drive pump chamber 26.

Thus, in each of the liquid supply devices 10*e* and 10*f* of the direct operation type, the liquid in the drive pump chamber 26 is discharged into the outflow pipe 32 by the forward movement of the drive rod 18, and the liquid is sucked into the drive pump chamber 26 from the inflow pipe 31 by the backward movement of the drive rod 18. Therefore, the liquid in the drive pump chamber is discharged directly into the discharge nozzle.

Both of the liquid supply device 10*e* shown in FIG. 19 and the liquid supply device 10*f* shown in FIG. 20 are used when the discharge load is heavier than the suction load. In using each of the liquid supply devices 10*e* and 10*f* when the suction load is heaver than the discharge load, however, the orifice member 43 and the valve member 53 are disposed at the valve holding portion 42 in a state in which their positional relation is reversed. Namely, the valve member 53 is put between the orifice member 43 and the end face 47 of the bellows 21. The inflow pipe 31 and the outflow pipe 32 each shown in FIGS. 19 and 20 are provided with the opening/closing valve 35 shown in FIG. 1.

Figure 21:
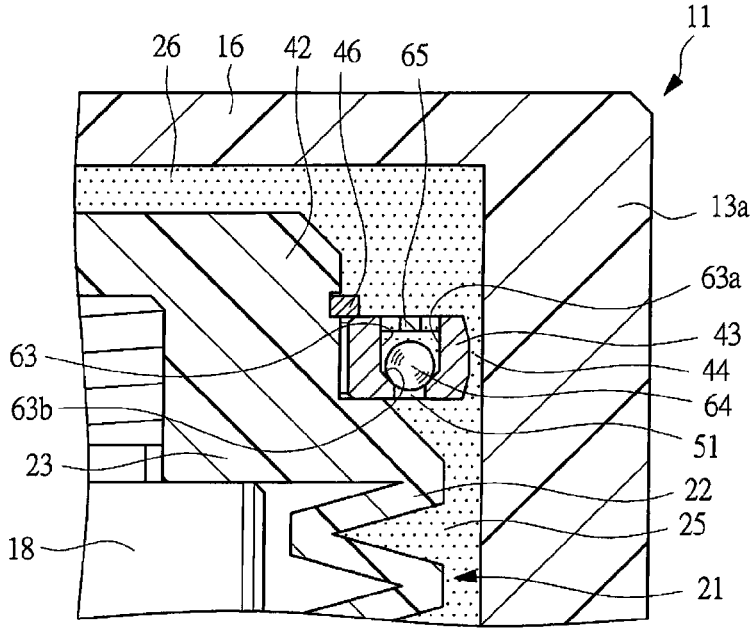
FIG. 21 is a sectional view showing modifications of an orifice member and a valve member.
Figure 22:
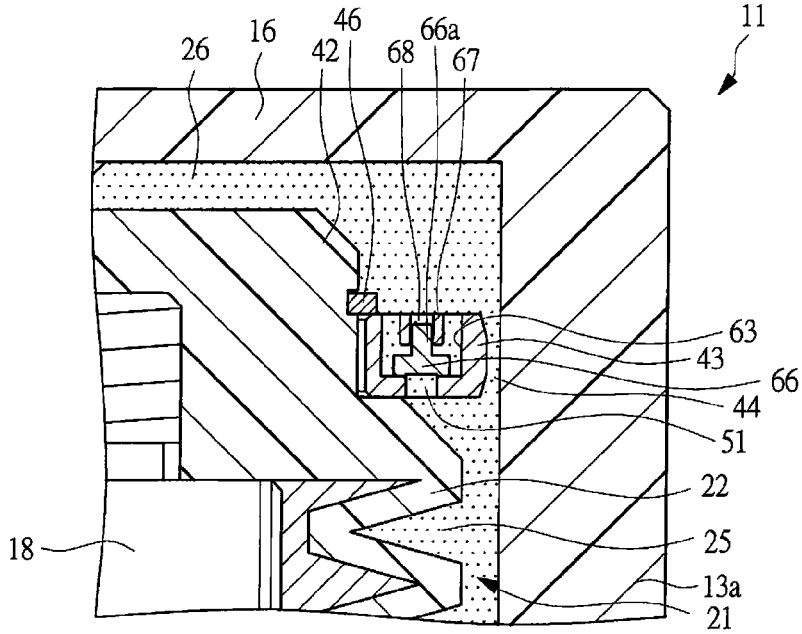
FIG. 22 is a sectional view showing other modifications of the orifice member and the valve member.

Each of FIGS. 21 and 22 is a modification of the orifice member 43 and the valve member 53. A valve-member receiving hole 63 coaxially with the through holes 51 is formed in the orifice member 43 shown in FIG. 21, and the valve-member receiving hole 63 has a large diameter hole 63*a*, and a taper hole 63*b* located between the large diameter hole 63*a* and the through hole 51. The plural through holes 51 are formed circumferentially at certain intervals, and the valve-member receiving hole 63 is formed continuously with the respective through holes 51, and a ball 64 as a valve member is disposed in the valve-member receiving hole 63. To prevent the ball 64 from being disengaged from the valve-member receiving hole 63, a retainer 65 is attached to an end portion of the valve-member receiving hole 63, and a penetration hole for guiding the liquid is formed in the retainer 65.

In the orifice member 43 shown in FIG. 22, a poppet valve 66 as a valve member is disposed in the valve-member receiving hole 63 formed coaxially with the through holes 51, and a valve shaft portion 66*a* is fitted in a guide hole 68 formed in the retainer 67.

In the orifice member 43 shown in FIGS. 21 and 22, the ball 64 and the poppet valve 66 are disposed so as to close the through holes 51 when the drive pump chamber 26 is pressurized. Therefore, the through holes 51 are blocked when the drive rod 18 moves forward, and the through holes 51 are opened when the drive rod 18 moves backward. In contrast, like the liquid supply device 10*b* shown in FIGS. 13 to 16, when the drive pump chamber 26 becomes in a negative pressure state by the backward movement of the drive rod 18, the orifice member 43 is disposed on a tip side of the drive rod 18 in a state in which respective upper and lower directions of FIGS. 21 and 22 are reversed.

In the liquid supply device according to the present invention, the communication chamber 25 formed between the housing 13*a* and a pump member such as the bellows 21 or diaphragm 62 is partitioned by the orifice member 43 with respect to the drive pump chamber 26. In a type of pressurizing the drive pump chamber 26 against the discharge load by the drive rod 18, when the through holes 51 are closed, since the liquid in the drive pump chamber 26 is choked and guided to the communication chamber 25 via the communication gap 44, the pressure variation of the drive pump chamber 26 is not propagated to the communication chamber 25. Meanwhile, in a type of sucking the drive pump chamber 26 against the suction load by the drive rod 18, when the through holes 51 are closed, since the liquid in the communication hole 25 is choked and guided to the drive pump chamber 26 via the communication gap 44, the pressure variation of the drive pump chamber 26 is not propagated to the communication chamber 25.

Accordingly, when the drive pump chamber 26 is expanded and contracted by the pump member, the communication chamber 25 formed between the pump member and the housing has no pressure variation, and the pump member such as the bellows 21 and the diaphragm 62 elastically deforms linearly with respect to the stroke movement of the drive rod 18.

Especially, at an initial period of the drive operation, the conventional flexible pump member is significantly elastically deformed by applying a pressure thereto, whereby the rising characteristic of the drive pump 11 deteriorates. In contrast, the present invention uses the orifice member 43 to partition the drive pump chamber 26 and the communication chamber 25, whereby the pressure variation in the drive pump chamber 26 is not propagated to the communication chamber 25, so that the rising characteristic of the drive pump can be enhanced.

Since each of the liquid supply devices according to the present invention uses the flexible bellows 21 or diaphragm 62 as a pump member to expand and contract the drive pump chamber 26, the pump member is not in slidable contact with an inner circumferential face of the housing unlike the syringe type. For this reason, since a sliding portion is not abraded, a leakage of the liquid from the drive pump is not caused, and the durability of the drive pump can be improved. Accordingly, doing frequent maintenance of the liquid supply device becomes unnecessary. Further, sine the present invention has no sliding portion, even when the liquid is slowly discharged, the flow variation due to a stick-slip phenomenon is not caused. The abrasive powder is not generated from the sliding portion, so that in the liquid supply device of a direct operation type of discharging directly the liquid from the discharge nozzle 34 by the drive pump, the abrasive powder is not mixed in the liquid, and yields of manufacturing semiconductor wafers and liquid crystal panels can be enhanced.

The present invention is not limited to the above-mentioned embodiments, and may be variously modified within a scope of not departing from the gist of the present invention. For example, the liquid supply device according to the present invention is not limited to a case of using, as objects to be applied, the semiconductor wafers and liquid crystal panels to discharge the liquid into them, and can applied to a case of supplying a fixed amount of liquid with high accuracy.

What is claimed is:

1. A liquid supply device, which expands and contracts a drive pump chamber by a drive rod, causes a liquid to flow in the drive pump chamber, and discharges the inflow liquid toward an outside from the drive pump chamber, the device comprising:

a housing for the drive pump chamber, in which the drive rod is reciprocably mounted forward and backward directions along an axial direction;

a pump member provided between the drive rod and the housing, the pump member having an end portion fixed to the drive rod, a communication chamber being formed between an inner circumferential face of the housing and the pump member, and the pump member elastically deforming axially according to a movement of the drive rod;

an orifice member attached to the end portion of the pump member so as not to be moved with respect to the drive rod, the orifice member partitioning an interior of the housing into the drive pump chamber and the communication chamber, a communication gap communicating with the drive pump chamber and the communication chamber being formed between an outer circumferential face of the orifice member and the housing; and a valve member disposed in the drive pump chamber, the valve member being movable with respect to the orifice member, the valve member blocking one or more through hole formed in the orifice member when the drive rod is moved forward, and opening the through hole when the drive rod is moved backward, wherein in a state of moving forward the drive rod to close the through hole, the drive pump chamber is driven for pressurization, and in a state of moving backward the drive rod, the liquid in the communication chamber is guided into the drive pump chamber via the though hole.

2. The liquid supply device according to claim 1, wherein the valve member is formed of an annular plate material, and is disposed opposite the plural through holes formed in the orifice member, and an auxiliary gap, which communicates with the drive pump chamber and the communication chamber when the drive rod is moved backward and when the valve member causes the through holes to be opened, is formed on least one side of an inner circumferential face side and an outer circumferential face side of the valve member.

3. The liquid supply device according to claim 2, wherein the valve member is disposed outside an annular valve guide attached to the drive rod, and a notch portion, which opens an auxiliary gap formed on an inner circumferential face side of the valve member during a backward movement of the drive rod, is formed in the valve guide.

4. The liquid supply device according to claim 1, further comprising:

a housing for liquid, which is provided with an inflow port connected to a liquid inflow pipe, and an outflow port connected to a liquid outflow pipe; and a liquid pump incorporated into the housing for liquid, and provided with an elastically deformable partition film member by which a liquid pump chamber communicating with the inflow and outflow ports, and a drive chamber communicating with the drive pump chamber are partitioned, wherein when the drive rod is moved forward, the partition film member is driven for pressurization by the liquid supplied from the drive pump chamber to the drive chamber.

5. The liquid supply device according to claim 1, wherein an inflow port communicating with the drive pump chamber and connected to a liquid inflow pipe, and an outflow port connected to a liquid outflow pipe are provide with the housing for the drive pump chamber, and when the drive rod is moved forward, the liquid is directly discharged from the drive pump chamber to the outflow port.

6. A liquid supply device, which expands and contracts a drive pump chamber by a drive rod to cause a liquid to flow in the drive pump chamber, and which discharges the inflow liquid exteriorly from the drive pump chamber, the device comprising:

a housing for the drive pump chamber, in which the drive rod is reciprocably mounted forward and backward directions along an axial direction;

a pump member provided between the drive rod and the housing, the pump member having an end portion fixed to the drive rod, a communication chamber being formed between an inner circumferential face of the housing and the pump member, and the pump member elastically deforming axially according to a movement of the drive rod;

an orifice member attached to the end portion of the pump member so as not to be moved with respect to the drive rod, the orifice member partitioning an interior of the housing into the drive pump chamber and the communication chamber, a communication gap communicating with the drive pump chamber and the communication chamber being formed between an outer circumferential face of the orifice member and the housing; and a valve member disposed in the drive pump chamber, the valve member being movable with respect to the orifice member, the valve member blocking one or more through hole formed in the orifice member when the drive rod is moved backward, and opening the through hole when the drive rod is moved forward, wherein in a state of moving backward the drive rod to close the through hole, the drive pump chamber is driven for suction, and in a state of moving forward the drive rod, the liquid in the drive pump chamber is guided into the communication chamber via the through hole.

7. The liquid supply device according to claim 6, wherein the valve member is formed of an annular plate material, and is disposed opposite the plural through holes formed in the orifice member, and an auxiliary gap, which communicates with the drive pump chamber and the communication chamber when the drive rod is moved forward and when the valve member causes the through hole to be opened, is formed on least one side of an inner circumferential face side and an outer circumferential face side of the valve member.

8. The liquid supply device according to claim 7, wherein the valve member is disposed outside an annular valve guide attached to the drive rod, and a notch portion, which opens an auxiliary gap formed on an inner circumferential face side of the valve member during a forward movement of the drive rod, is formed in the valve guide.

9. The liquid supply device according to claim 6, further comprising:

a housing for liquid, which is provided with an inflow port connected to a liquid inflow pipe, and an outflow port connected to a liquid outflow pipe; and a liquid pump incorporated into the housing for liquid, and provided with an elastically deformable partition film member by which a liquid pump chamber communicating with the inflow and outflow ports, and a drive chamber communicating with the drive pump chamber are partitioned, wherein when the drive rod is moved backward, the partition film member is driven for suction by the liquid supplied from the drive chamber to the drive pump chamber.

10. The liquid supply device according to claim 6, wherein the housing for the drive pump chamber is provided with an inflow port communicating with the drive pump chamber and connected to a liquid inflow pipe, and an outflow port connected to a liquid outflow pipe, and when the drive rod is moved backward, the liquid is directly sucked into the drive pump chamber from the inflow port.

11. The liquid supply device according to claim 2, wherein a difference between an outer diameter dimension of the outer circumferential face of the orifice member and an inner diameter dimension of an inner circumferential face of the housing for the drive pump chamber is 0.1 mm or less.

12. The liquid supply device according to claim 2, wherein an outer diameter dimension of the valve member is smaller than an outer diameter dimension of the orifice member.

13. The liquid supply device according to claim 1, wherein the valve member is formed of a ball or poppet valve, and the valve member is disposed in each of a plurality of the through holes formed in the orifice member.

14. The liquid supply device according to claim 7, wherein a difference between an outer diameter dimension of the outer circumferential face of the orifice member and an inner diameter dimension of an inner circumferential face of the housing for the drive pump chamber is 0.1 mm or less.

15. The liquid supply device according to claim 7, wherein an outer diameter dimension of the valve member is smaller than an outer diameter dimension of the orifice member.

16. The liquid supply device according to claim 6, wherein the valve member is formed of a ball or poppet valve, and the valve member is disposed in each of a plurality of the through holes formed in the orifice member.

* * * * *